US009152125B2

(12) United States Patent
Koyama

(10) Patent No.: US 9,152,125 B2
(45) Date of Patent: Oct. 6, 2015

(54) IMAGE FORMING UNIT AND IMAGE FORMING APPARATUS THAT INCORPORATES THE IMAGE FORMING UNIT

(71) Applicant: Oki Data Corporation, Tokyo (JP)

(72) Inventor: Tetsu Koyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/315,398

(22) Filed: Jun. 26, 2014

(65) Prior Publication Data

US 2015/0003867 A1 Jan. 1, 2015

(30) Foreign Application Priority Data

Jun. 28, 2013 (JP) ..... 2013-135690

(51) Int. Cl.
*G03G 21/18* (2006.01)

(52) U.S. Cl.
CPC ..... *G03G 21/1821* (2013.01); *G03G 21/1825* (2013.01); *G03G 2221/1853* (2013.01); *G03G 2221/1861* (2013.01)

(58) Field of Classification Search
CPC ..... G03G 15/0865; G03G 2221/1861; G03G 21/1825
See application file for complete search history.

(56) References Cited

U.S. PATENT DOCUMENTS

2012/0269543 A1* 10/2012 Hashimoto ..... 399/111

FOREIGN PATENT DOCUMENTS

JP 2006-048018 A 2/2006

* cited by examiner

*Primary Examiner* — David Gray
*Assistant Examiner* — Michael Harrison
(74) *Attorney, Agent, or Firm* — Panitch Schwarze Belisario & Nadel LLP

(57) ABSTRACT

An image forming unit includes a first unit and a second unit. The first unit includes a first engagement portion and a rotatably supported image bearing body. An electrostatic latent image is formed on the image bearing body. A second unit includes a second engagement portion and a rotatably supported developer material bearing body. The developer bearing body develops the electrostatic latent image with a developer material into a developer image. The second unit is coupled to the first unit such that the first engagement portion engages the second engagement portion. A plurality of urging members that are mounted in a vicinity of one end of an axis of rotation of developer material bearing body, and urge the first unit and the second unit in directions such that the image bearing body and the developer material bearing body are urged against each other.

20 Claims, 16 Drawing Sheets

IMAGE FORMING UNIT AND IMAGE FORMING APPARATUS THAT INCORPORATES THE IMAGE FORMING UNIT

BACKGROUND OF THE INVENTION

1. Field of the Invention

This invention relates to an image forming unit and an image forming apparatus that incorporates the image forming unit.

2. Description of the Related Art

Electrophotographic image forming apparatus are known which include at least one image forming unit detachably mounted on the main body of the apparatus. The image forming unit includes, for example, a photoconductive drum on which an electrostatic latent image is formed, a charging roller that charges the photoconductive drum, a developing roller that develops the electrostatic latent image with toner, a supplying roller that supplies the toner to the developing roller, and a cleaning mechanism that cleans the surface of the photoconductive drum. These structural elements are assembled as an integral unit, and are driven in rotation during printing.

Japanese Patent Application Publication No. 2006-48018 discloses a developing unit that includes a photoconductor rotatably supported on first side frames, a developing roller rotatably supported on second side frames, and springs that are mounted on the first side frames and urges the photoconductor and the developing roller against each other.

In other words, the image forming unit according to Japanese Patent Application Publication No. 2006-48018 includes a first unit on which an image bearing body carrying an electrostatic latent image thereon is rotatably supported, a second unit on which a developer holding body that develops an electrostatic latent image is rotatably supported, and an urging member that is mounted on each longitudinal end portion of either the first unit or the second unit, the urging member urging one of the first unit and second unit against the other of the first unit and the second unit. A single urging member disposed on each longitudinal end portion of either the first unit or the second unit is not sufficient to urge the image bearing body and the developing body uniformly along their lengths.

SUMMARY OF THE INVENTION

An object of the invention is to provide an image forming unit and an image forming apparatus which ensures that photoconductive body and a developer bearing body are urged under a uniform imaging force along their length.

An image forming unit includes a first unit and a second unit. The first unit includes a first engagement portion and a rotatably supported image bearing body. An electrostatic latent image is formed on the image bearing body. A second unit includes a second engagement portion and a rotatably supported developer material bearing body. The developer bearing body develops the electrostatic latent image with a developer material into a developer image. The second unit is coupled to the first unit such that the first engagement portion engages the second engagement portion. A plurality of urging members that are mounted in a vicinity of one end of an axis of rotation of developer material bearing body, and urge the first unit and the second unit in directions such that the image bearing body and the developer material bearing body are urged against each other.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described with reference to the accompanying drawings.

First Embodiment

{Configuration}

Figure 1:
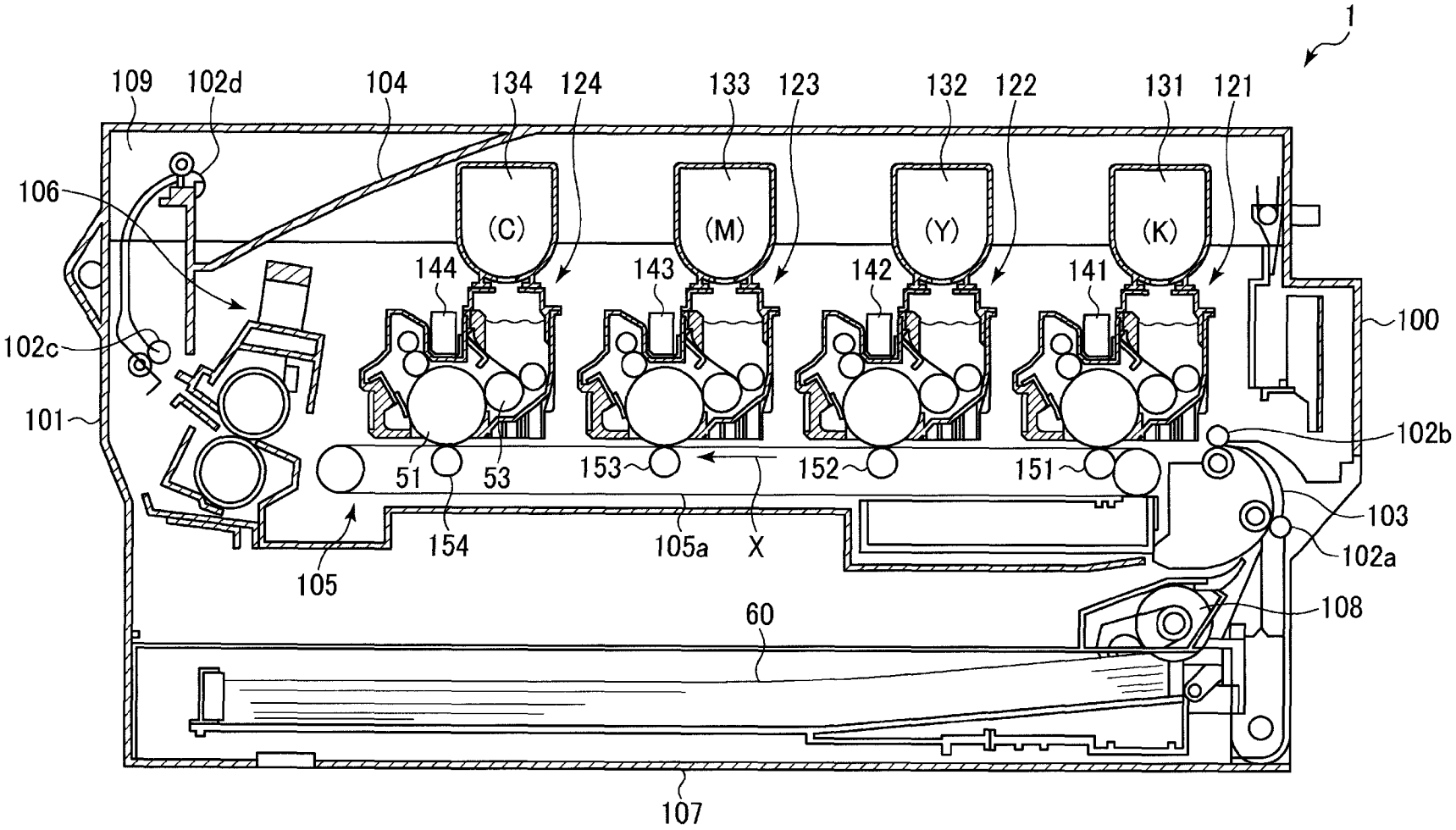
FIG. 1 is a cross-sectional view, illustrating the outline of an image forming apparatus according to a first embodiment.

FIG. 1 is a cross-sectional view illustrating the outline of an image forming apparatus 1 according to a first embodiment. The image forming apparatus 1 is a color electrophotographic printer capable of printing black (K), yellow (Y), magenta (M), and cyan (C) images, and forms a full color image on a sheet of print medium by an electrophotographic process.

The image forming apparatus 1 includes image forming units 121-124 that form black, yellow, magenta, and cyan images, respectively, and a body 100 to which the image forming units 121-124 are detachably mounted.

The image forming units 121-124 each include a photoconductive drum 51 on which an electrostatic latent image is formed, and a developing roller 53 that carries a developer material or toner thereon and supplies the toner to the electrostatic latent image formed on the photoconductive drum 51.

The body 100 includes a lower frame 101, which is a lower main portion, and a top cover 109 configured to open and close relative to the lower frame 101. The print medium or paper 60 is transported in an S-shaped transport path 103. Transport rollers 102*a*-102*d* are disposed along the transport path 103, and cooperate to transport the paper 60. A paper cassette 107 is located at the upstream end of the transport path 103, and holds a stack of the paper 60 therein. A stacker 104 is disposed at the downstream end of the transport path 103, and holds a stack of printed paper 60.

A paper feeding section 108 is disposed in the vicinity of the paper cassette 107, and feeds the paper 60 onto the transport path 103 on a sheet-by-sheet basis. A transfer belt unit 105 includes a transfer belt 105*a* that electrostatically attracts the paper 60, and transports the paper 60 in a direction shown by arrow X. The image forming units 121-124 are aligned along the transport path 103 from upstream to downstream in this order so that the transfer belt 105*a* is sandwiched between the image forming units 121-124 and the transfer belt unit 105.

An exposing unit 141 faces the photoconductive drum 51, and illuminates the charged surface of the photoconductive drum 51. A developer cartridge 131 as a developer holding device is detachably attached on the upper portion of the image forming unit 121, so that the user can replace the developer cartridge 131 when it is exhausted. The developer cartridge 131 holds the toner therein and supplies the toner into the image forming unit 121. Transfer rollers 151 as transfer members are disposed such that the transfer belt 105*a* is sandwiched under pressure between each transfer roller 151 and a corresponding photoconductive drum 51. Likewise, a developer cartridge 132, an exposing unit 142, and a transfer roller 152 are disposed in the image forming unit 122. A developer cartridge 133, an exposing unit 143, and a transfer roller 153 are disposed in the image forming unit 123. A developer cartridge 134, an exposing unit 144, and a transfer roller 154 are disposed in the image forming unit 124.

A fixing unit 106 is disposed downstream of the transfer belt 105 with respect to the direction of travel of the paper 60, and fixes the toner image on the paper 60 into a permanent image.

Figure 2:
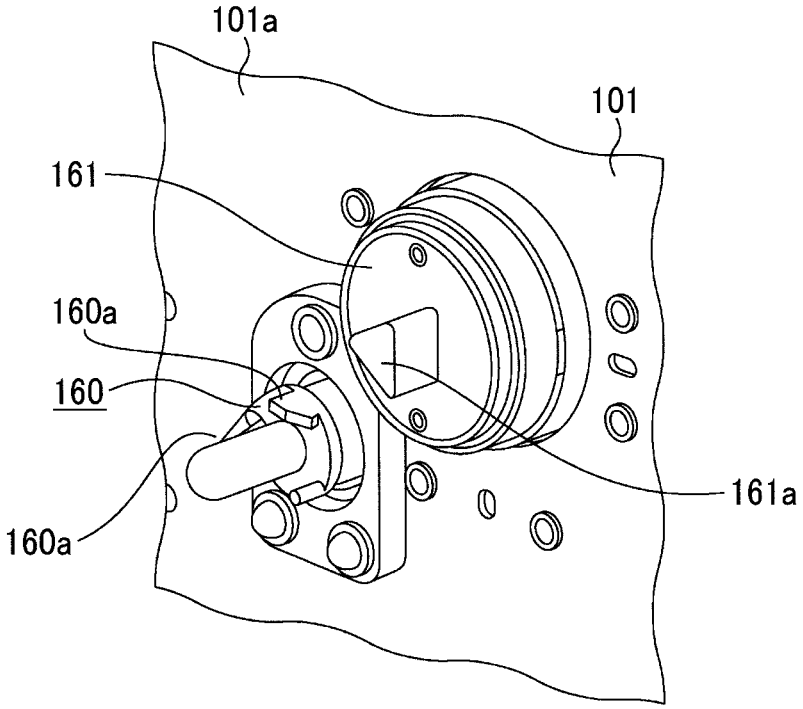
FIG. 2 is a partial perspective view illustrating a drive mechanism.

The body 100 includes a drive force transmitting mechanism for transmitting a drive force to the photoconductive drum 51 and the developing roller 53. Specifically, a developing roller coupling 161 and a drum coupling 160 are mounted on a side wall 101*a* of the lower frame 101 as shown in FIG. 2. FIG. 2 is a partial perspective view illustrating a drive mechanism. The drum coupling 160 includes a projection 160*a* through which the drive force is transmitted to the photoconductive drum 51. The developing roller coupling 161 includes a projection 161*a* through which the drive force is transmitted to the developing roller 53. The drum coupling 160 and developing roller coupling 161 have conventional Oldham couplings, which have no aligning function, so that no aligning is performed even if the drum coupling 160 is not quite in line with a drum coupling receiving portion 212 and the developing roller coupling 161 is not quite in line with a coupling portion 313*a*.

Each of the image forming units 121-124 may be substantially identical; for simplicity only the operation of the image forming unit 121 for forming black images will be described, it being understood that the other image forming units may work in a similar fashion. Likewise, each of the developer cartridges 131-134 may be substantially identical. Each of the exposing units 141-144 may be substantially identical. Each of the transfer rollers 151-154 may be substantially identical. By way of example, a description will be given of the configuration of the image forming unit 121 for black images.

{Configuration of Image Forming Unit}

Figure 3:
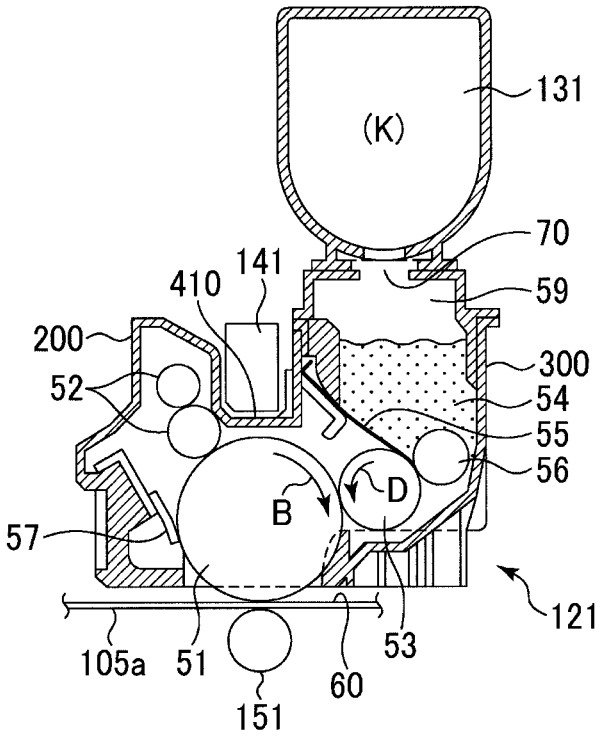
FIG. 3 is a cross-sectional view, illustrating the configuration of an image forming unit.
Figure 4:
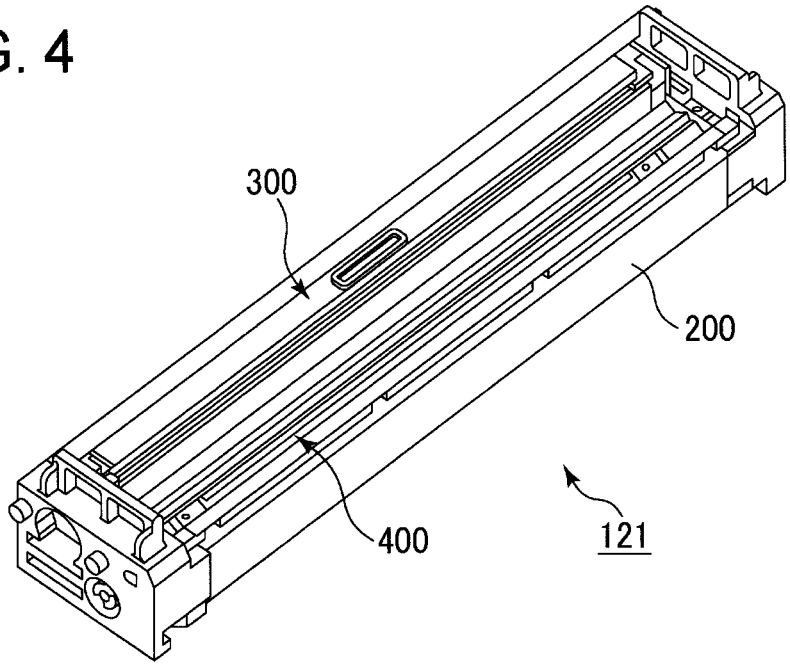
FIG. 4 is a perspective view of the image forming unit.
Figure 5:
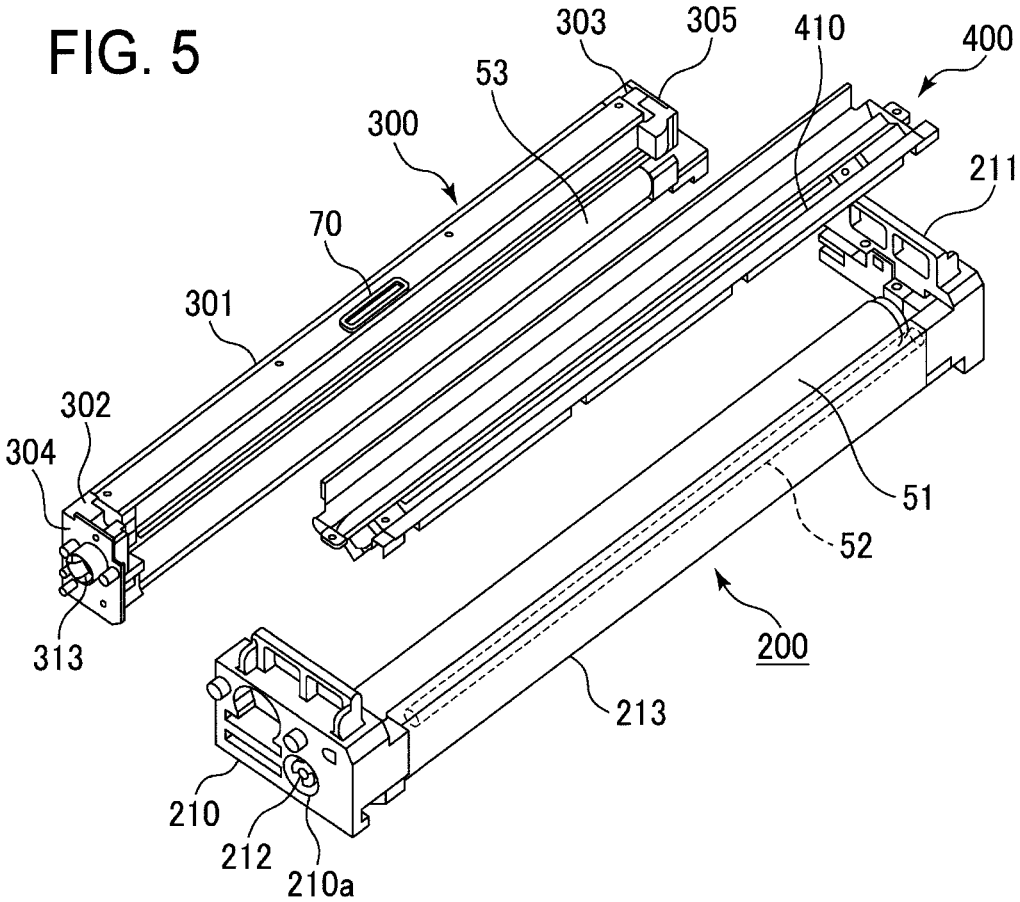
FIG. 5 is an exploded view of the image forming unit.

FIG. 3 is a cross-sectional view illustrating the configuration of the image forming unit 121. FIG. 4 is a perspective view of the image forming unit 121. FIG. 5 is an exploded view of the image forming unit 121. The configuration of the image forming unit 121 will be described with reference to FIGS. 3-5.

The image forming unit 121 includes a drum unit 200 as a first unit having the photoconductive drum 51, a developing unit 300 as a second unit having the developing roller 53, and a drum cover 400 that protects the photoconductive drum 51. The photoconductive drum 51 is rotatably supported on the drum unit 200. The developing roller 53 is rotatably supported on the developing unit 300. The drum cover 400 includes an exposure window 410 through which the light emitted from the exposing unit 141 passes to the photoconductive drum 51. The developing unit 300 and drum cover 400 are assembled to the drum unit 200, so that the drum unit 200, developing unit 300, and the drum cover 400 are assembled in an integral assembly. Specifically, the drum unit 200 and developing unit 300 are coupled to each other by means of an engaging mechanism, so that the developing unit 300 is urged by the urging mechanism against the drum unit 200. The urging mechanism will be desired later in detail.

The drum unit 200 includes the photoconductive drum 51, a charging unit 52, and a cleaning unit 57. The developing unit 300 includes the developing roller 53, a developing blade 55, a supplying roller 56, and a developer chamber 59 that holds the toner therein. A toner receiving opening 70 is formed at an upper portion of the developing unit 300, so that the developer chamber 59 receives the toner through the toner receiving opening 70 from the developer cartridge 131. The photoconductive drum 51 rotates in a direction shown by arrow B in FIG. 3. The charging unit 52, exposing unit 141, developing roller 53, transfer roller 151, and cleaning unit 57 are disposed around the photoconductive drum 51 in this order with respect to the direction of rotation of the photoconductive drum 51.

The charging unit 52 uniformly charges the circumferential surface of the photoconductive drum 51. The exposing unit 141 illuminates the charged circumferential surface of the photoconductive drum 51 to form an electrostatic latent image thereon. The developing blade 55 is in pressure contact with the circumferential surface of the developing roller 53 to form a thin layer of the toner 54 on the developing roller 53. The developing roller 53 is in pressure contact with the circumferential surface of the photoconductive drum 51, and supplies the toner 54 to the electrostatic latent image, thereby developing the electrostatic latent image with the toner 54-into a toner image. The transfer roller 51 transfers the toner image, which has been formed on the photoconductive drum 51, onto the paper 60 carried on the transfer belt 105. The cleaning unit 57 removes the residual toner from the photoconductive drum 51.

A further description will be given of the configuration of the drum unit 200 and developing unit 300.

Referring to FIG. 5, the developing unit 300 includes a main frame 301, side frames 302 and 303, and longitudinal end frames 304 and 305. The main frame 301 convers the developing roller 53 and supplying roller 56 with some clearance between the main frame 301 and the circumferential surfaces of these rollers, thereby defining the developing chamber 59. The main frame 301 has the toner receiving opening 70 formed in an upper surface thereof. The side frames 302 and 303 are disposed such that the developing roller 53 and the supplying roller 56 are rotatably supported by the side frames 302 and 303. A drive mechanism is mounted on an end portion of the side frame 302, receives a drive force from the main body 100, and drives the developing roller 53 and supplying roller 56 in rotation. The end frames 304 and 305 are attached to the image forming unit 121 to partially cover the outside of the side frames 302 and 303 and cover the side frames 302 and 303.

Figure 6:
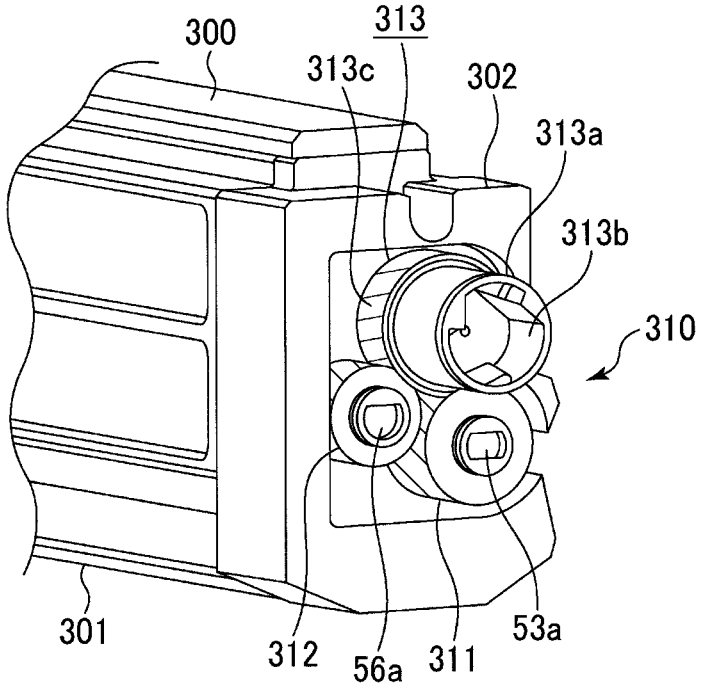
FIG. 6 is a perspective view of a developing unit as seen from a side frame when an end frame has been removed.
Figure 7:
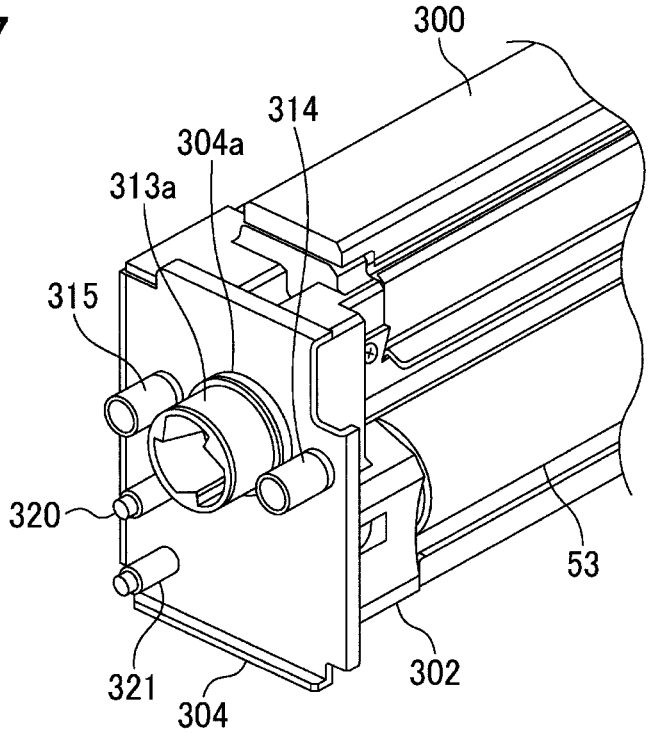
FIG. 7 is a perspective view of the developing unit as seen from the side frame when the end frame has been attached.
Figure 8:
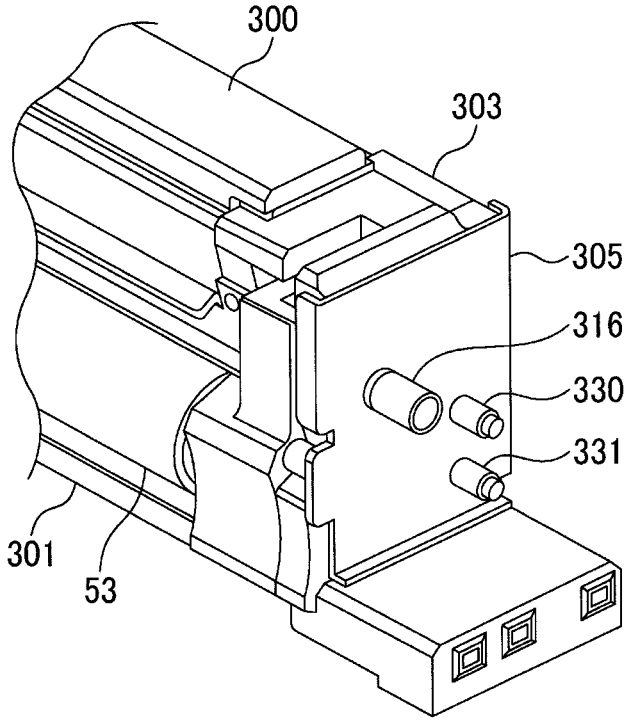
FIG. 8 is a perspective view of the developing unit as seen from the side frame when the end frame has been attached.

FIG. 6 is a partial perspective view of the developing unit 300 as seen from the side frame 302 when the end frame 304 has been removed. FIG. 7 is a partial perspective view of the developing unit 300 as seen from the side frame 302 when the end frame 304 has been attached. FIG. 8 is a perspective view of the developing unit 300 as seen from the side frame 303 when the end frame 305 has been attached.

Referring to FIG. 6, a drive gear train 310 is mounted on the outer surface of the side frame 302 and transmits the drive force to the developing roller 53 and supplying roller 56. The drive gear train 310 includes a developing gear 312 secured to the end portion of a shaft member 53*a* of the developing roller 53 and a supplying roller gear 313 secured to the end portion of the rotational member 56*a* of the supplying roller 56. The supplying roller gear 313 is mounted on one longitudinal end portion of a rotatable shaft (not shown) rotatably supported on the outer side of the side frame 302, and is rotatable together with the rotational shaft. The supplying roller gear 313 includes a coupling portion 313*a* into which the developing roller coupling 161 on the body 100 fits for transmitting the drive force, and gear teeth 313*c* in a meshing engagement with the developing roller gear 311 and the supplying roller gear 312. The coupling portion 313*a* has a recess 313*b* that receives a projection 161*a* of the developing roller coupling 161.

Referring to FIG. 7, the end frame 304 is fitted to the side frame 302 in a direction of the rotational axis of the developing roller 53, covering the drive gear train 310. The end frame 304 has an opening 304*a* through which the coupling portion 313*a* of the supplying roller gear 313 extends outwardly in the direction of the rotational axis of the developing roller 53.

Referring to FIG. 8, the side frame 303 is fitted to the side frame 302 and extends outwardly from the the side frame 302 in a direction of the rotational axis of the developing roller 53, covering the bearings of the developing roller 53 and the supplying roller 56.

Referring to FIG. 5, the drum unit 200 includes a drum frame 213, and side frames 210 and 211. The drum frame 213 extends in a direction parallel to the rotational axis of the photoconductive drum 51, and covers the charging unit 52 and cleaning unit 57. The side frames 210 and 211 are located at the longitudinal ends of the drum frame 213, and rotatably support the photoconductive drum 51. The drum coupling receiving portion 212 is formed at one longitudinal end portion of the photoconductive drum 51, and receives the drum coupling 160 therein. The side frame 210 has a through-hole 210*a* through which the drum coupling receiving portion 212 extends outwardly.

Figure 9:
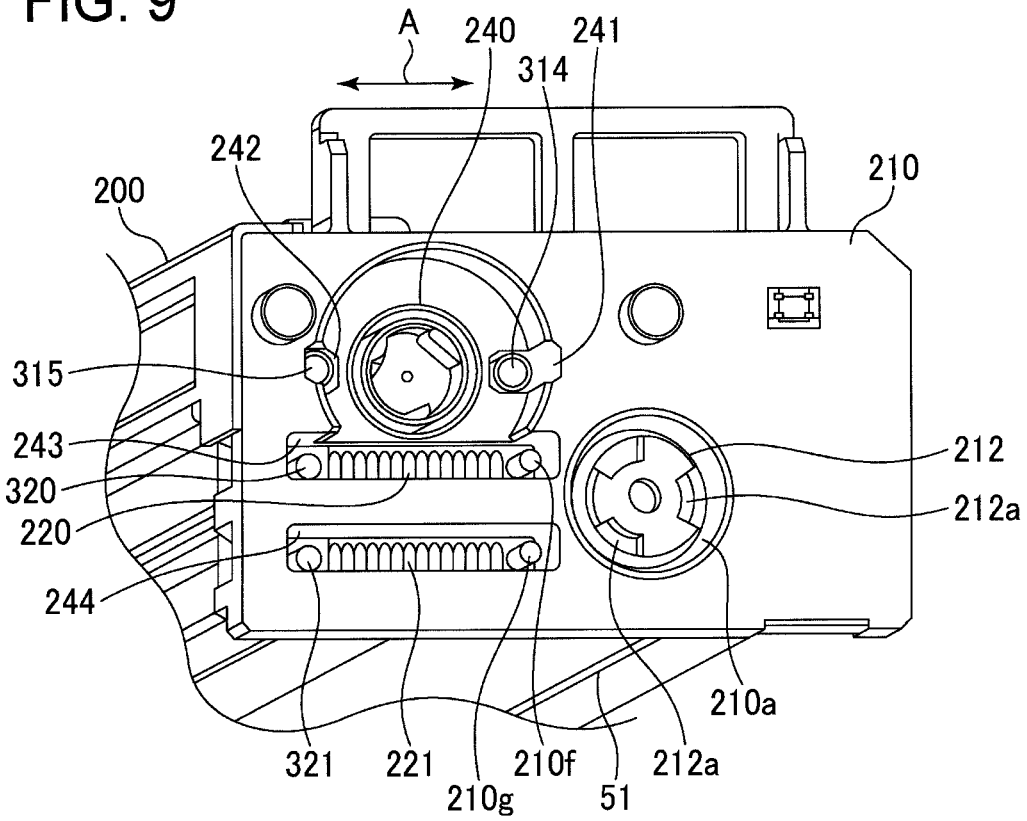
FIG. 9 is a partial perspective view of a drum unit as seen from the side frame.
Figure 10:
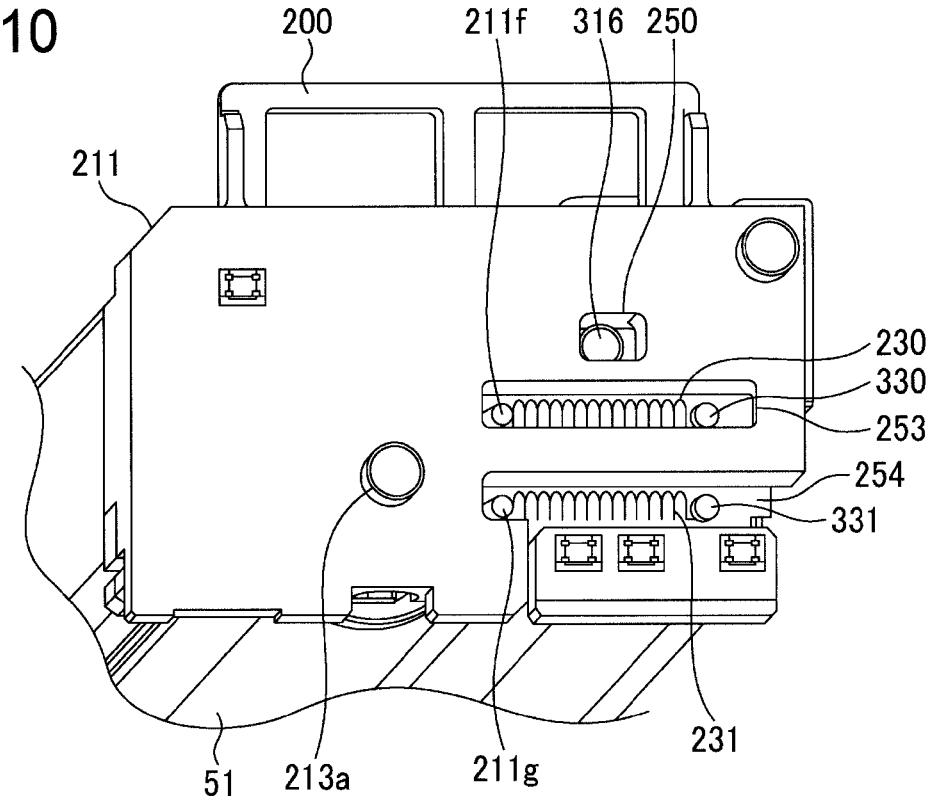
FIG. 10 is a partial perspective view of the drum unit as seen from a side of the drum unit opposite the side shown in FIG. 9.

FIG. 9 is a partial perspective view of the drum unit 200 as seen from the side frame 210. FIG. 10 is a partial perspective view of the drum unit 200 as seen from a side of the drum unit 200 opposite the side shown in FIG. 9.

Referring to FIG. 9, the drum coupling receiving portion 212 has three recesses 212*a* that receive the three projections 160*a* of the drum coupling 160. The side frame 210 has a through hole 240 through which the coupling portion 313*a* of the supplying roller gear 313 extends when the developing unit 300 has been mounted on the drum unit 200.

Referring to FIG. 10, the side frame 211 includes the drum shaft 213*a* by which the photoconductive drum 51 is rotatably supported.

Figure 11:
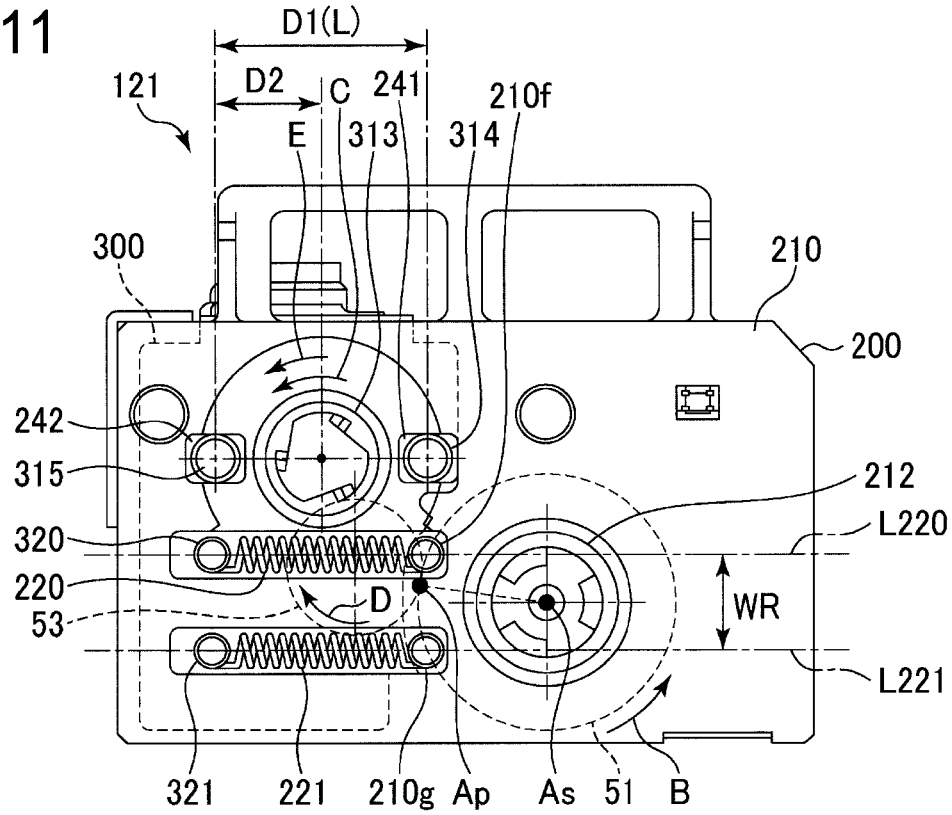
FIG. 11 is a side view, illustrating the drum unit and developing unit when they are assembled together.
Figure 12:
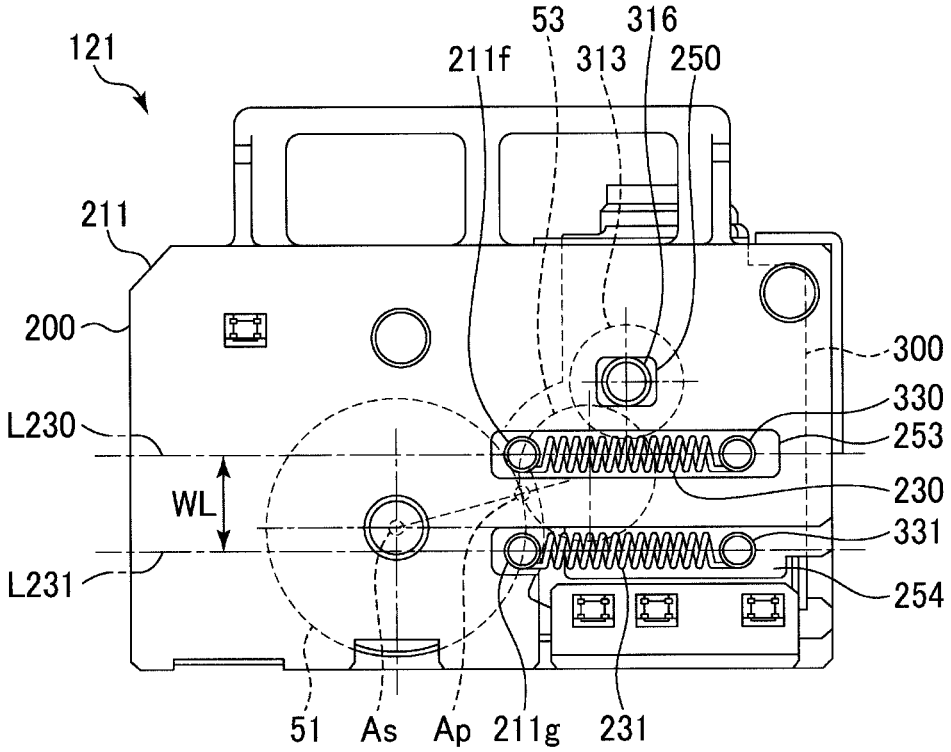
FIG. 12 is a side view as seen from a side of the drum unit opposite the side shown FIG. 9.

FIG. 11 is a side view, illustrating the drum unit 200 and developing unit 300 when they are assembled together. FIG. 12 is a side view as seen from a side of the drum unit 200 opposite the side shown FIG. 9.

{Engaging Construction}

With reference to FIGS. 6-12, a description will be given of the assembly structure of the drum unit 200 and developing unit 300.

The drum unit 200 includes an engagement means and the developing unit 300 includes another engagement means that engages the engagement means of the drum unit 200. The engagement means and the another engagement means allow the drum unit 200 and developing unit 300 to move into and out of contact engagement with each other while preventing the drum unit 200 and the developing unit 300 from moving in directions except the direction in which they move into and out of contact engagement with each other.

Referring to FIGS. 9 and 10, the drum unit 200 has a positioning hole 241 as a first engagement portion formed at one longitudinal end portion of the drum unit 200, and a positioning hole 242 as a second engagement portion spaced apart from the positioning hole 241, and a positioning hole 250 as a third engagement portion formed in the vicinity of the other longitudinal end of the drum unit 200.

Referring to FIGS. 7 and 8, the developing unit 300 has a support post 314 as a first engaged portion that engages a wall that defines the positioning hole 241, a support post 315 as a second engaged portion that engages a wall that defines the positioning hole 242, and a support post 316 as a third engaged portion that engages a wall that defines the positioning hole 250.

Once the image forming unit 121 has been attached to the body 100, the support posts 314, 315, and 316 are positioned such that the center of gravity, P, of the developing unit 300 lies within a triangular area bounded by the support posts 314, 315, and 316 as seen from above. In other words, assuming that the support posts 314-316 are projected onto a horizontal plane, the projected support posts 314-316 make a triangular area and the center of gravity, P, lies within the triangular area.

The support posts 314 and 315 are located in the vicinity of the supplying roller gear 313 of the developing unit 300, and the support post 316 is located on a side of the developing unit opposite the support posts 314 and 315. The support posts 314 and 315 are positioned such that the rotational axis of the supplying roller gear 313 is located in the vicinity of the line connecting the centers of the supports 314 and 315, and substantially in the midway between the supports 314 and 315. Specifically, the support posts 314 and 315 extend in parallel to the rotational axis of the supplying roller gear 313, and project outwardly from the end frame 304. The line connecting the support posts 314 and 315 is in a horizontal direction substantially perpendicular to a gravitational direction, which may be inclined at an angle of up to ±10 degrees with respect to the gravitational direction. In the horizontal direction, the center of gravity of the developing unit 300 lies between the support posts 314 and 315. The rotational axis of the supplying roller gear 313 may not be exactly in the middle of the line connecting the support posts 314 and 315. When the support posts 314 and 315 are equidistant from the rotational axis of the supplying roller gear 313, the line connecting the support posts 314 and 315 may be at an angle with respect to a horizontal line passing through the rotational axis of the supplying roller gear 313.

The support post 316 is located in the vicinity of the rotational axis of the supplying roller gear 313. Specifically, the center of the support post 316 is located within a circle having a radius equal to 0.3×D1, where D1 is the center-to-center distance between the support posts 314 and 315, therefore the center of the support post 316 is between the support posts 314 and 315. In the first embodiment, the support post 316 is mounted to the end frame 305 so that the support post 316 is substantially in line with the supplying roller gear 313. The height of support post 316 in the gravitational direction may be substantially the same as that of the support posts 314 and 315 but is not limited to this relation.

Referring to FIGS. 9 and 10, the positioning holes 241, 242, and 250 of the drum unit 200 are formed at locations such that the support posts 314, 315, and 316 of the developing unit 300 can fit into the positioning holes 241, 242, and 250, respectively. Specifically, the through hole 240 is formed in the side frame 210 and is located between the positioning holes 241 and 242. The positioning hole 250 (FIG. 10) is formed at a location on a side of the drum unit 200 opposite the through hole 240 (FIG. 9).

The positioning holes 241, 242, and 250 are shaped such that the support posts 314, 314, and 316 can move in a direction such that the drum unit 200 and developing unit 300 move into and out of contact engagement with each other, and such that the drum unit 200 and the developing unit 300 are prevented from moving in directions other than they move into and out of contact engagement with each other. The direction in which the drum unit 200 and developing unit 300 move into and out of engagement with each other is substantially horizontal as shown by arrow A in FIG. 9, i.e., substantially perpendicular to a substantially vertical direction, which in turn is substantially parallel to the gravity direction. The substantially vertical direction may form an angle of ±10 degrees with the gravity direction. The positioning holes 241, 242, and 250 each have an upper wall surface and a lower wall surface that limit movement of the support posts 314, 315, and 316 in the gravitational direction, and opposing side wall surfaces or left and right wall surfaces that limit movement of the support posts 314, 315, and 316 in the substantially horizontal directions. The upper and lower wall surfaces are substantially parallel to each other and substantially perpendicular to the gravity direction, i.e., the upper and lower wall surfaces are substantially horizontal. The distance between the upper wall surfaces and lower wall surfaces is slightly larger than the outer diameter of the support posts 314, 315, and 316. The gaps between the support posts and the upper wall surfaces and the gaps between the support posts 314, 315, and 316 and the lower wall surfaces are selected to be in the range of 0.01 mm to 0.05 mm. The distance between the side wall surfaces is larger than the outer diameter of the support posts by more than 1 mm (e.g., 1 to 5 mm). The positioning holes 241, 242, and 250 are elongate holes or slotted openings that extend substantially in horizontal directions. The positioning hole 250 is on a side of the drum unit 200 opposite the positioning holes 241 and 242, and the axes of the positioning holes 241, 242, and 250 lie in a common plane and the axis of the positioning hole 250 is substantially between those of the positioning holes 241 and 242.

Referring to FIG. 11, once the drum unit 200 has engaged the developing unit 300, the support posts 314 and 315 have fitted in the positioning holes 241 and 242 of the developing unit 300, respectively, so that the support posts 314 and 315 abut the lower wall surfaces of the positioning holes 241 and 242 in such a way that the support posts 14 and 315 can slide on the lower wall surfaces. Referring to FIG. 12, the support post 316 of the developing unit 300 has fitted in the positioning hole 250 and abuts the lower wall surface of the positioning hole 250 so that the support post 316 can slide on the lower wall surface. In this manner, the developing unit 300 is supported such that the developing unit 300 can move substantially horizontally into and out of engagement with the drum unit 200.

{Urging Mechanism}

Figure 13:
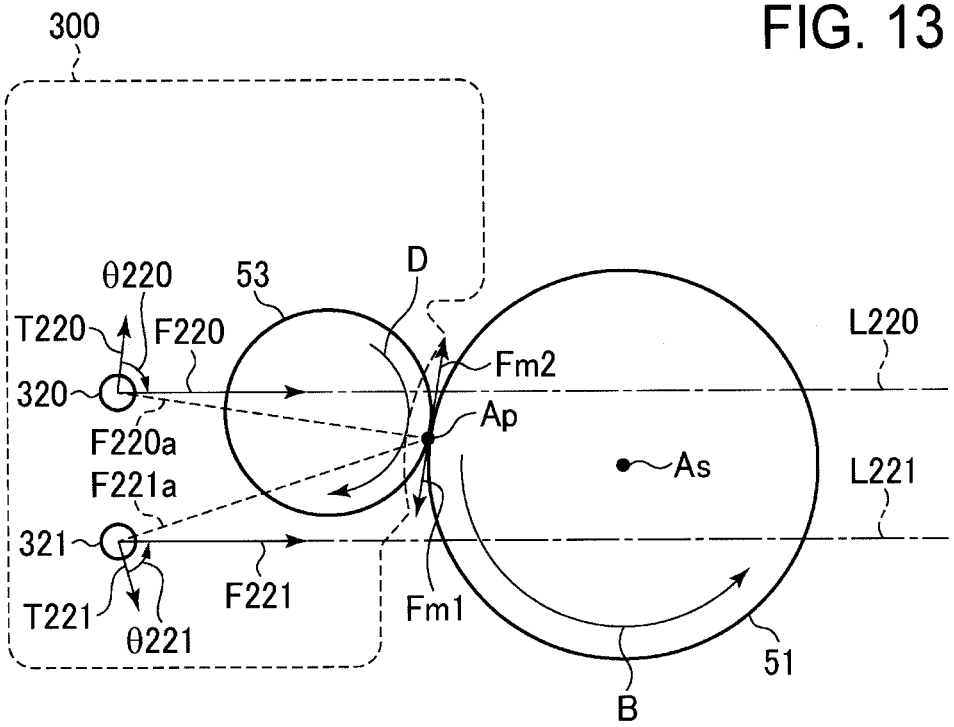
FIGS. 13 and 14 illustrate an urging mechanism of the image forming unit.
Figure 14:
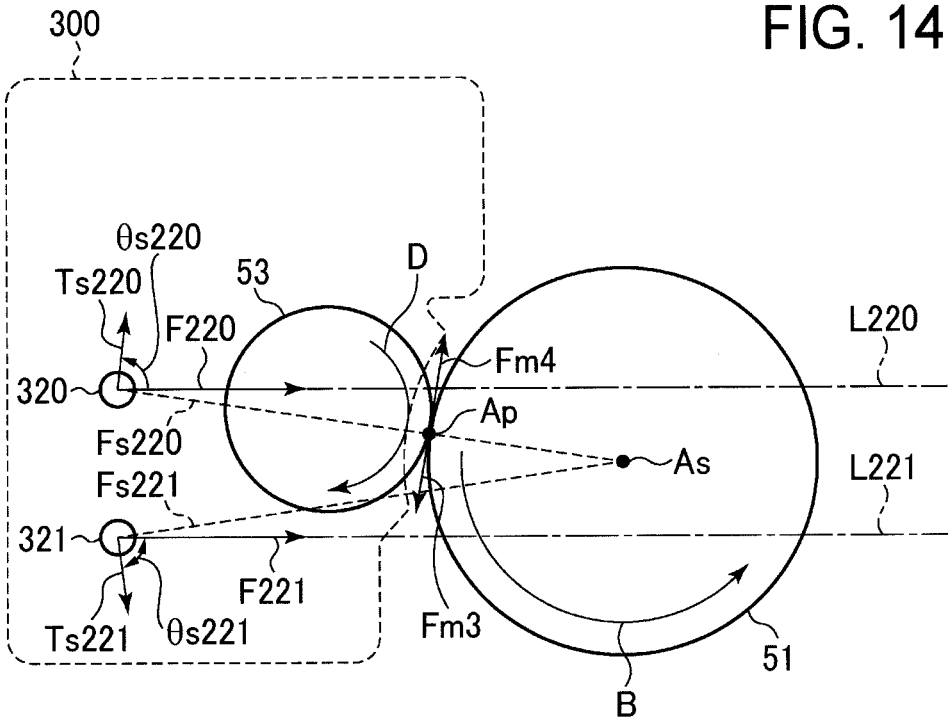

FIGS. 13 and 14 illustrate the urging mechanism of the image forming unit 121.

The image forming unit 121 includes a plurality of urging members mounted in the vicinity of one longitudinal end of the developing roller 53, the urging members urging the developing unit 300 in a direction in which the photoconductive drum 51 and developing roller 53 are in pressure contact with each other. The urging mechanism is configured as follows:

As shown in FIGS. 11 and 12, the image forming unit 121 includes an urging member 220 as a first urging member and an urging member 221 as a second urging member, which are mounted in the vicinity of the supplying roller gear 313. The image forming unit 121 also includes an urging member 230 and an urging member 231 on a side of the image forming unit 200 opposite the urging members 220 and 221. The respective urging members 220, 221, 230, and 231 urge the photoconductive drum 51 and the developing roller 53 against each other.

As shown in FIG. 7, an urging member supporting post 320 as a first support member is formed on the developing unit 300 in the vicinity of the supplying roller gear 313. The urging member supporting post 320 supports the urging member 220. Another urging member supporting post 321 as a second support member is formed on the developing unit 300. The urging member supporting post 321 supports the urging member 221. The urging member supporting posts 320 and 321 are metal posts on which the end portions of the urging members 220 and 221 are hooked, respectively. The urging member supporting posts 320 and 321 are located under the support post 315 of the end frame 304, and project outwardly of the end frame 304 in directions parallel to the rotational axis of the developing roller 53.

Referring to FIG. 8, the urging member supporting posts 330 and 331 are formed on a side of the developing unit 300 opposite the urging member supporting posts 320 and 321. The urging member supporting posts 330 and 331 are metal posts on which the end portions of the urging members 230 and 231 are hooked, respectively. The urging members supporting posts 330 and 331 project outwardly of the end frame 305 in a direction parallel to the rotational axis of the developing roller 53.

Referring to FIG. 9, urging member securing posts 210*f* and 210*g* that support the urging members 220 and 221, respectively. Elongate holes or slotted opening 243 and 244 are formed in the side frame 210 under the positioning holes 241 and 242, and receive the urging members 220 and 221 therein, respectively. The urging member securing posts 210*f* and 210*g* extend into the elongate holes 243 and 244, respectively.

Referring to FIG. 10, urging member securing posts 211*f* and 211*g*, which support the urging members 230 and 231, are formed on a side of the drum unit 220 opposite the urging member securing posts 210*f* and 210*g*. Elongate holes or slotted openings 253 and 254 are formed in the side frame 211 under the positioning hole 250, and receive the urging member securing posts 211*f* and 211*g* therein. The urging members securing posts 211*f* and 211*g* extend into the grooves 243 and 244, respectively.

Referring to FIG. 11, when the drum unit 200 and the developing unit 300 have engaged each other, the urging member 220 has one end secured to the urging member securing post 210*f* and the other end secured to the urging member supporting post 320. Likewise, the urging member 221 has one end secured to the urging member securing post 210*g* and the other end secured to the urging member supporting post 321. The urging members 220 and 221 are, for example, tension springs, and extend between the urging member securing posts and corresponding the urging member supporting posts. The urging member 220 applies a tensile force to the urging member securing post 210*f* and the urging member supporting post 320 to pull them toward each other. The urging member 221 applies a tensile force to the urging member supporting post 210*g* and the urging member supporting post 321 to pull them toward each other.

As shown in FIG. 12, the urging member 230 has one end secured to the urging member securing post 211*f* and the other end secured to the urging member supporting post 330. The urging member 231 has one end secured to the urging member securing post 211*g* and the other end secured to the urging member supporting post 331. The urging members 230 and 231 each are, for example, a tension spring that extends between the urging member securing post and the corresponding support post. The urging force of the urging member 231 acts on the urging member securing post 211*g* and the urging member supporting post 331 to pull them toward each other. The urging members 220, 221, 230, and 231 are tension springs whose urging forces are substantially identical. The urging members 220, 221, 230, and 231 have urging forces which vary in a range within ±20% of their average urging force.

As shown in FIGS. 13 and 14, the urging member 220 applies a first urging force F220 to the urging member supporting post 320, and the urging member 221 applies a second urging force F221 to the urging member supporting post 321. The urging forces F220 and F221 cause the photoconductive drum 51 and the developing roller 53 to be in pressure contact with each other at a contact area Ap. The urging forces F220 and F221 act in directions substantially parallel to the direction in which the drum unit 200 and the developing unit 300 are urged to each other. The direction in which the drum unit 200 and the developing unit 300 are urged may be at an angle within ±10 degrees with the parallel direction. A description will be given of the positional relationships among the urging members 220 and 221, photoconductive drum 51, and developing roller 53.

As shown in FIGS. 11 and 13, the contact area Ap between the photoconductive drum 51 and developing roller 53 lies between a substantially horizontal plane L220 in which the urging force F220 lies and a substantially horizontal plane L221 in which the urging force F221 lies. The contact area Ap is closer to the plane 220 than to the plane L221. Additionally, the rotational axis As of the photoconductive drum 51 lies in a space between the plane L220 and the plane L221. The urging members 220 and 221 extend in substantially parallel directions and are spaced apart by a distance WR. Therefore, the planes L220 and L221 are substantially parallel with each other.

The urging members 220 and 221 may be disposed as follows:

As shown in FIG. 13, the urging force F220 may be resolved into a component F220*a* acting toward the contact area Ap and another component T220 acting in a direction perpendicular to the component F220*a*. Likewise, the urging force F221 may be resolved into a component F221*a* acting toward the contact area Ap and another component T221 acting in a direction perpendicular to the component F221*a*. The components T220 and T221 act in substantially opposite directions such that one of the components is a mirror image of the other. In addition, as shown in FIG. 14, the urging force F220 may be resolved into a component Fs220 acting from the urging member supporting post 320 toward the rotational axis As and another component Ts220 acting in a direction perpendicular to the component Fs220. The urging force F221 is resolved into a component Fs221 acting from the urging member supporting post 321 toward the rotational axis As and another component Ts221 acting in a direction perpendicular to the component Fs221. The components Ts220 and Ts221 act in substantially opposite directions with respect to a line perpendicular to a line tangent to the photoconductive drum 51.

The urging members 220 and 221 may be disposed such that the following relationships (a), (b), and (c) are satisfied.

(a) The urging members 220 and 221 are disposed so that they produce urging forces in such directions as to urge the developing roller 53 and the photoconductive drum 51 against each other. Specifically, the urging members 220 and 221 are disposed such that the planes L220 and L221 make an angle less than 90° with a plane in which the contact area Ap and the rotational axis As lie.

(b) The urging members 220 and 221 are disposed so that the component T220 and component T221 act in opposite directions. Specifically, as shown in FIG. 13, the urging members 220 and 221 are disposed to satisfy the following relationship (1) or (2).

$$\theta 220>0 \text{ and } \theta 221<0 \quad (1)$$

$$\theta 220<0 \text{ and } \theta 221>0 \quad (2)$$

where angles are positive in value in the counterclockwise, θ220 is the angle that the direction of the component T220 forms with the plane L220 and θ221 is the angle that the direction of the component T221 forms with the plane L221.

(c) The urging members 220 and 221 are disposed such that the components Ts220 and Ts221 act in substantially opposite directions. As shown in FIG. 14, assuming that angles are positive in value in the counterclockwise, the urging members 220 and 221 are disposed to satisfy the following relationship (3) or (4).

$$\theta s220>0 \text{ and } \theta s221<0 \quad (3)$$

$$\theta s220<0 \text{ and } \theta s221>0 \quad (4)$$

where angles are positive in value in the counterclockwise, θs220 is the angle that the direction of the component Ts220 forms with the plane L220 and θs221 is the angle that the direction of the component Ts221 forms with the plane L221.

Likewise, the urging members 230 and 231 are disposed in a similar manner to the urging members 220 and 221. Specifically, the urging member supporting posts 330 and 331, elongate holes or slotted openings 253 and 254, urging member securing posts 211*f* and 211*g*, urging members 230 and 231 have substantially the same configuration as the urging member supporting posts 320 and 321, elongate holes or slotted openings 243 and 244, urging member securing posts 210*f* and 210*g*, and urging members 220 and 221, respectively, and are disposed as mirror images of the urging member supporting posts 320 and 321, elongate holes 243 and 244, urging member securing posts 210*f* and 210*g*, and urging members 220 and 221. The contact area Ap and the rotational axis As are in a space bounded by a plane L230 in which the urging member supporting post 331 and the urging member supporting post 330 and the urging member securing post 211*f* lie, and a plane L231 in which the urging member supporting post 331 and the urging member securing post 211*g* lie. The urging members 230 and 231 extend in parallel directions, and the planes L230 and L231 are spaced by a distance WL. In FIG. 12, the planes L230 and L231 are predetermined distances lower than the position at which the positioning hole 250 receives the supporting post 316. The positioning holes 241, 242, and 250 are elongate holes. The planes L220, L221, L230, and L231 extend in directions substantially parallel to the long walls of the positioning holes 241, 242, and 250. Arranging the positioning holes and these planes in this manner allows the urging members 220, 221, 230, and 231 to efficiently apply their urging forces to the contact area Ap.

With the above-described configuration, the urging members 220, 221, 230, and 231 allow the photoconductive drum 51 and developing roller 53 to be in contact with each other at the contact area Ap under a predetermined pressure.

{Operation of Image Forming Apparatus}

The operation of the image forming apparatus 1 will be described with reference to FIG. 1-3. Once printing is activated, the paper feeding section 108 feeds a sheet of paper 60 from the paper cassette 107 into the transport path 103, in which the sheet of paper 60 is transported to the image forming units 121-124. The image forming units 121-124 form toner images of corresponding colors. When the paper 60 passes through the image forming units 121-124 in sequence, the toner images of the respective colors are transferred onto the paper 60 carried on the transfer belt 105*a* one over the other in registration. The paper 60 then passes through the fixing unit 106, so that the toner image are fixed before the paper 60 is discharged onto the stacker 104.

In each of the image forming units 121-124, the supplying roller 56 supplies toner of a corresponding color to the developing roller 53, and the developing blade 55 forms a thin layer of the toner having uniform thickness on the developing roller 53. The charging unit 52 uniformly charges the surface of the photoconductive drum 51, and the exposing unit 141 illuminates the charged surface of the photoconductive drum 51 in accordance with print data to form an electrostatic latent image. The developing roller 53 supplies the toner to the electrostatic latent image, thereby developing the electrostatic latent image with the toner into a toner image. As the paper 60 passes through the image forming unit, the toner image is electrostatically transferred onto the paper 60. The cleaning unit 57 removes the toner that failed to be transferred and remains on the photoconductive drum 51, and the residual toner is then collected in a toner collecting section (not shown).

The image forming unit 121 operates as follows:

When the user attaches the image forming unit 121 onto the body 100, the image forming apparatus 1 operates as follow.

The top cover 109, drum coupling 160, developing roller coupling 161 are interlocked such that when the user opens the top cover 109, the drum coupling 160 and developing roller coupling 161 are retracted into the side wall 101*a* of the lower frame 101. When the user closes the top cover 109, the drum coupling 160 and the developing roller coupling 161 extend out of the side wall 101*a*, so that the three projections 160*a* of the drum coupling 160 fit into the three recesses 212*a*. Likewise, the portion 161*a* fits into the recess 313*b* of the coupling portion 313*a* of the supplying roller gear 313.

During printing, a drive source (not shown) drives the drum coupling 160 and developing roller coupling 161 in rotation. The drive force is then transmitted to the image forming unit 121 so that the photoconductive drum 51 and developing roller 53 rotate. Specifically, as shown in FIG. 11, the photoconductive drum 51 rotates in the B direction, the supplying roller gear 313 rotates in a direction shown by arrow C, and the developing roller 53 rotates in a direction shown by arrow D.

A description will be given of the forces that are developed during the operation of the image forming unit 121. Parts of the developing unit 300 are subjected to various forces: the load torque that causes the supplying roller gear 313 to rotate, the weight of the developing unit 300, and the frictional force that acts between the photoconductive drum 51 and the developing roller 53.

The torque or turning effect, weight, and frictional force affect the contact pressure at the contact area Ap where the photoconductive drum 51 and developing roller 53 apply to each other. Fluctuation of the contact pressure between the photoconductive drum 51 and developing roller 53 can be minimized by reducing the effects of the torque, weight, and frictional force exerted on the contact pressure.

An approach to cancel out the torque or turning effect and weight or eliminate the effects of the torque or turning effect and weight on the operation of the developing unit 300 will be described with reference to FIGS. 15A-15B, 16A-16B, 17A-17B, 18A-18B, and 21-23. FIGS. 15A, 16A, 17A, and 18A are side views as seen from the supplying roller gear 313 side of the developing unit 300. FIGS. 15B, 16B, 17B, and 18B are side views as seen from a side of the developing unit 300 opposite the supplying roller gear 313. References Q1, Q2, R1, R2, S1, S2, T1, T2, U1, and U2 denote the positions of supporting posts that are formed on the developing unit 300 and support the developing unit 300 on the supplying roller gear 313 side. References Q3, R3, S3, T3, and U3 denote the positions of supporting posts that support the developing unit 300 on a side of the developing unit 300 opposite the supplying roller gear 313 side.

An approach to cancel out the torque or turning effect or eliminate the effect of the torque or turning effect on the operation of the developing unit 300 will be described with reference to FIGS. 15A and 15B. If the rotational axis O of the supplying roller gear 313 is not to be fixed, the developing unit 300 should be secured at least two locations thereof in order to cancel out rotational force. This can be accomplished by carefully selecting the positions of two adjacent support posts and inclination of surfaces of stoppers that hold the developing unit 300.

The support posts Q1 and Q2 are selected such that the support posts Q1 and Q2 are point-symmetric with respect to the rotational axis O of the supplying roller gear 313. The center-to-center distance L1 between the support post Q1 and the rotational axis O is equal to the center-to-center distance L2 between the supporting post Q2 and the rotational axis O.

Stoppers are disposed on the body 100 such that when the supplying roller gear 313 is rotated in the E direction, the support posts Q1 and Q2 apply forces against the surfaces Q1*a* and Q2*a* of the stoppers in a direction substantially normal to the surfaces Q1*a* and Q2*a*. The surfaces Q1*a* and Q2*a* counteract the forces applied thereto so that the counteracting forces are equal to and opposite to the forces applied by the support posts Q1 and Q2

To summarize, the supplying roller gear 313 is positioned preferably substantially at the midway between the support posts 314 and 315. However, the ratio of the center-to-center distance D2 between the support post 315 and the supplying roller gear 313 to that D1 between the support posts 314 and 315 may be in the range of 0.4 to 0.6.

As described above, the torque exerted on the developing unit 300 is cancelled out by the reaction of the two support posts 314 and 315 (i.e., Q1 and Q2) disposed in the vicinity of the supplying roller gear 313. As a result, no torque or turning effect acts on the support post Q3 (i.e., support post 316). This implies that the position of the support post Q3 is not limited. No inclination limitation is placed on the surface Q3*a* (FIGS. 15A and 15B) of a stopper formed on the body 100 that supports the support post Q3 thereon.

Figure 15A:
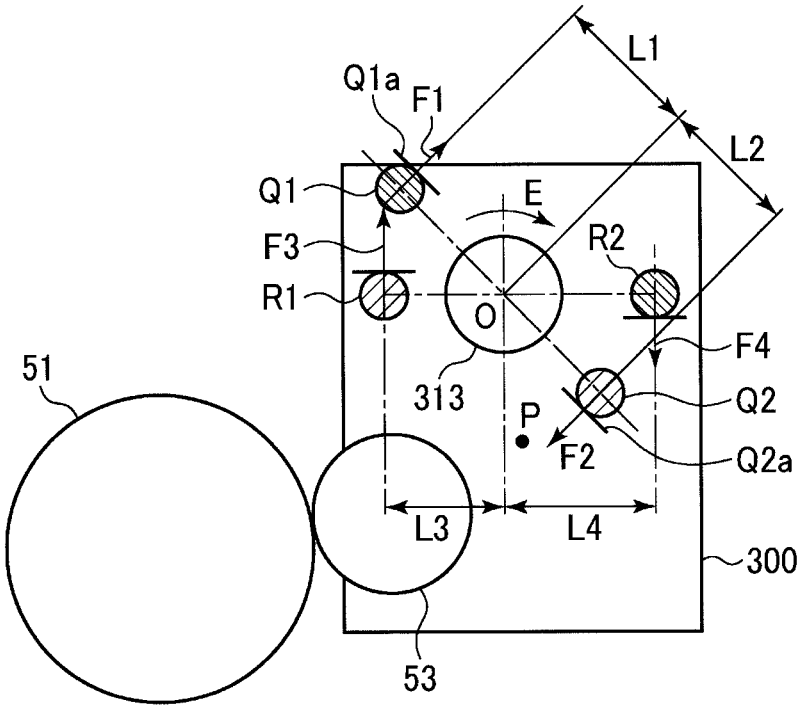
FIGS. 15A, 16A, 17A, and 18A are side views as seen from the supplying roller gear side of the developing unit.
Figure 15B:
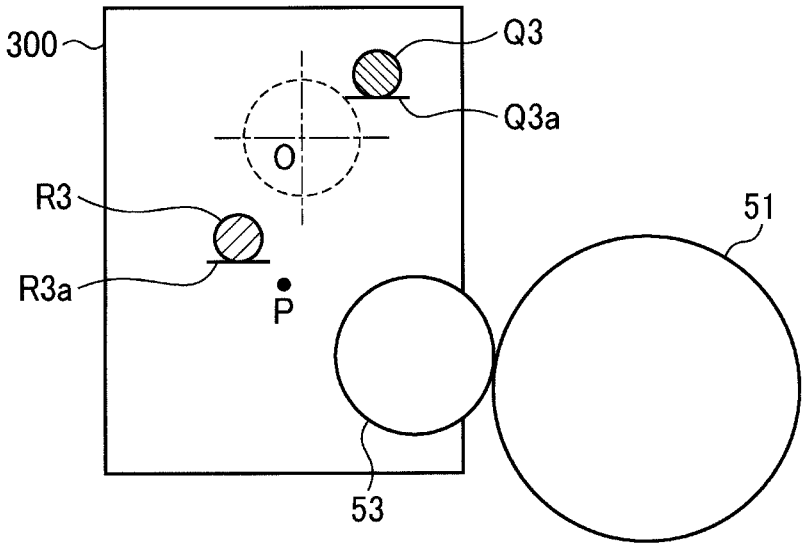
FIGS. 15B, 16B, 17B, and 18B are side views as seen from a side of the developing unit opposite the supplying roller gear.

When the rotational axis O of the supplying roller gear 313 is on a line passing through the centers of a pair of support posts 314 and 315 (i.e., R1 and R2) but the support posts 314 and 315 are not equidistant from the rotational axis O of the supplying roller gear 313 (i.e., the distance L3 in FIG. 15A is not equal to the distance L4), the torque or turning effect exerted on the developing unit 300 can be cancelled out as long as a pair of the support posts 314 and 315 (i.e., R1 and R2) are aligned horizontally. Just as in the support post Q3, no torque or turning effect is exerted on the support post R3 and therefore the position and inclination of the surface R3*a* are not limited.

Figure 16A:
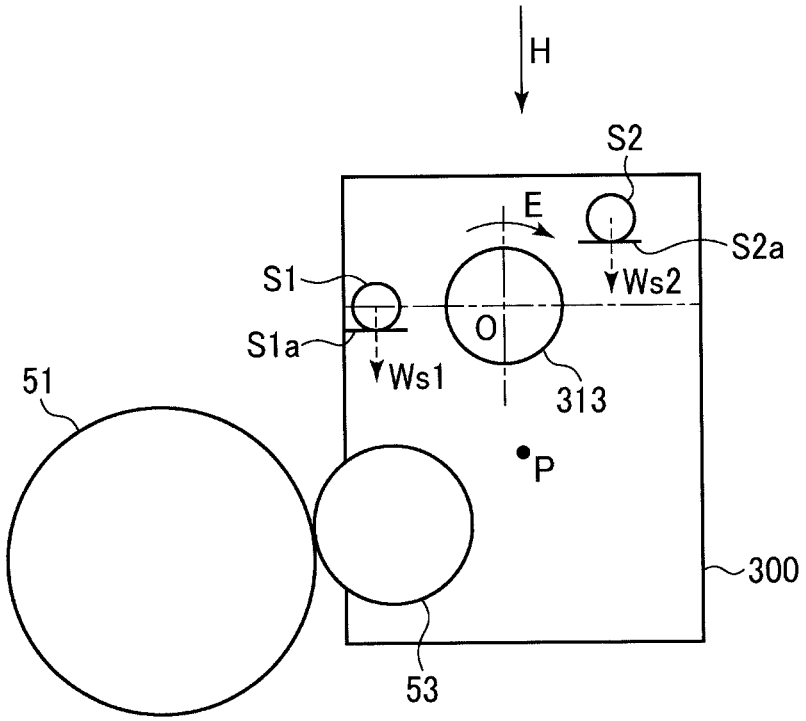
Figure 16B:
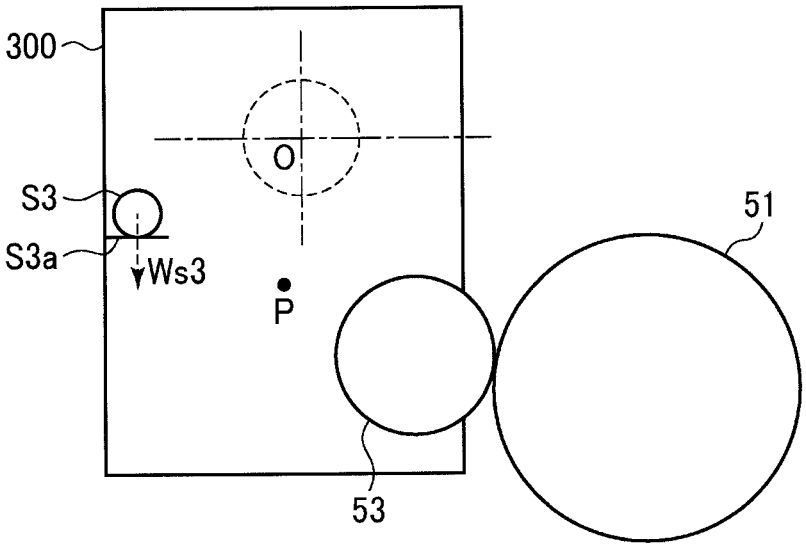
Figure 21:
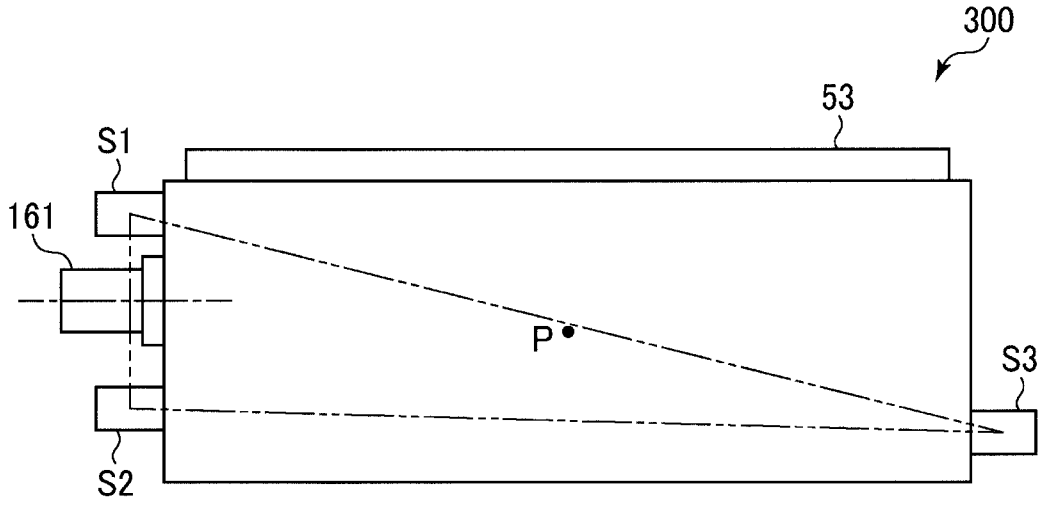
FIG. 21 is a view of the developing unit 300 as seen from above or in the H shown by arrow H in FIG. 16A.

An approach to cancel out the weight or eliminate the effect of the weight of the developing unit 300 on the operation of the developing unit 300 will be described with reference to FIGS. 16A, 16B, and 21. FIG. 21 is a view of the developing unit 300 as seen from above or in a direction shown by arrow H in FIG. 16A.

To cancel out the weight of the developing unit 300, the support posts S1, S2, and S3 are disposed as shown in FIG. 21 such that the center of gravity P of the developing unit 300 lies in a triangular horizontal plane defined by the support posts S1, S2, and S3. The support posts S1, S2, and S3 are not limited in their positions in the gravitational direction. Also, the positions of the support posts S1, S2, and S3 in the gravitational direction may be different from one another. Likewise, the position of the center of gravity P in the gravitational direction is not limited.

By limiting the bottom surfaces of the support posts S1, S2, and S3 in the horizontal planes S1*a*, S2*a*, and S1*a*, the forces Ws1, Ws2, and Ws3, which are exerted by the weight of the developing unit 300 on the support posts S1, S2, and S3 and are in the gravitational direction, are cancelled out.

As described above, the rotational axis O of the supplying roller gear 313 is preferably in the vicinity of a line L (i.e., distance D1) passing the through the center of the support posts 314 as the first engagement and the support posts 315 as the second engagement. In other words, the ratio of the distance D3 between the rotational axis O and the line L is equal to or shorter than 0.2D1, Di being the center-to-center distance D1 between the support posts 314 and 315. Equivalent effects may be obtained as long as the distance D3 is equal to or less than 0.2D1.

Figure 22:
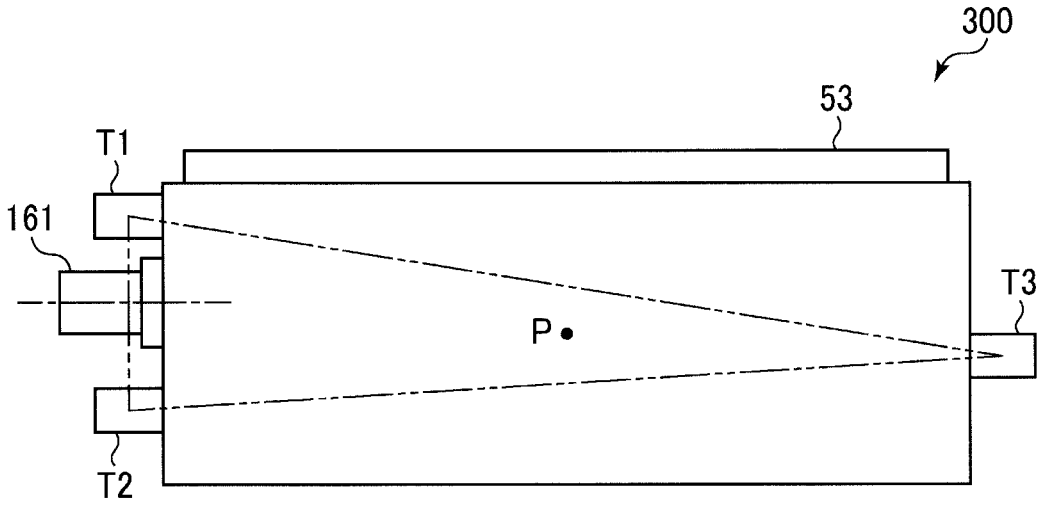
FIG. 22 is a view of the developing unit as seen in the H direction shown in FIG. 17A.

An approach to simultaneously cancel out the torque and weight or eliminate the effects of the torque and weight on the operation of the developing unit 300 will be described. FIG. 22 is a view of the developing unit 300 as seen in the H direction shown in FIG. 17A. The support posts T1, T2, and T3 are disposed such that the center of gravity P of the developing unit 300 lies in a triangular horizontal plane bounded by the longitudinal axes of the support posts T1, T2, and T3.

Figure 17A:
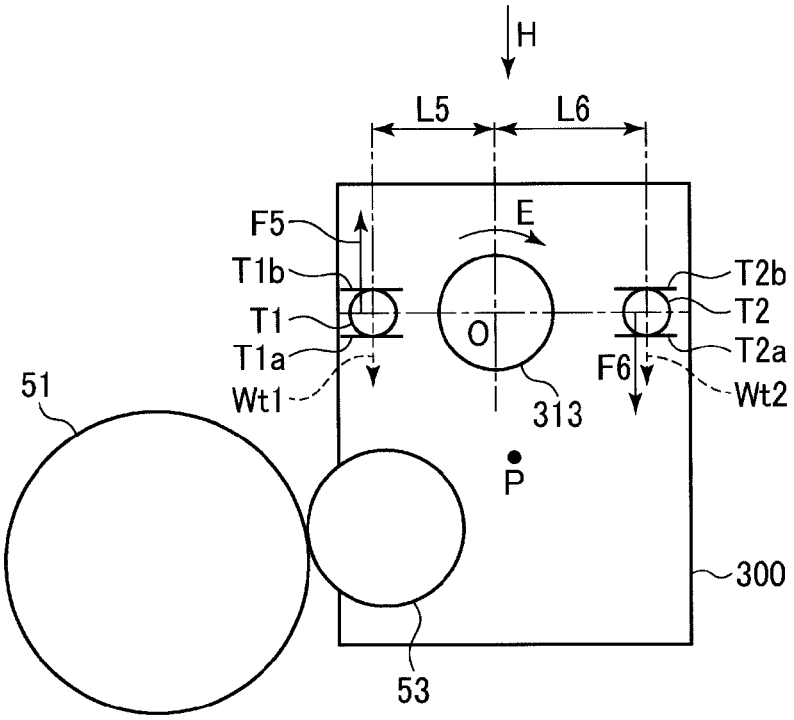
Figure 17B:
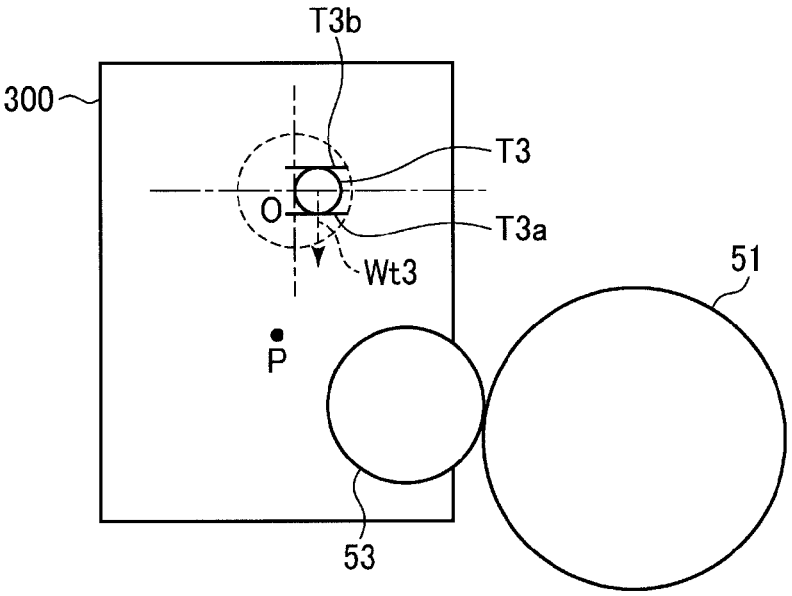

As shown in FIGS. 17A and 17B, to cancel out the weights Wt1, Wt2, and Wt3 exerted on the support posts T1, T2, and T3, counter forces should be applied to the horizontal surfaces of the support posts T1, T2, and T3, the counter forces acting in directions opposite to the weights Wt1, Wt2, and Wt3.

To support the developing unit 300 such that the developing unit 300 can move in horizontal directions while the torque or turning effect is cancelled out, the stoppers with surfaces T1*b*, T2*b*, and T3*b* are formed on the body 100, the surfaces T1*b*, T2*b*, and T3*b* lying in horizontal planes substantially parallel to the horizontal planes T1*a*, T2*a*, and T3*a*.

As shown in FIG. 17A, the support posts T1 and T2 in the vicinity of the supplying roller gear 313 are arranged such that the rotational axes O lies on the line connecting the axes of the support posts T1 and T2.

The above-described arrangement of the support posts T1 and T2 allows the surfaces T1*b* and T2*a* to receive the forces F5 and F6 due to the torque or turning effect applied to the support posts T1 and T2. There is no limitation on the distance L5 between the support post T1 and the rotational axis O and the distance L6 between the support post T1 and the rotational axis O. Although the support post T3 is as high as the support posts T1 and T2 in a gravitational direction in FIG. 17B, the position of the support posts T1, T2, and T3 may be different in a gravitational direction.

Figure 23:
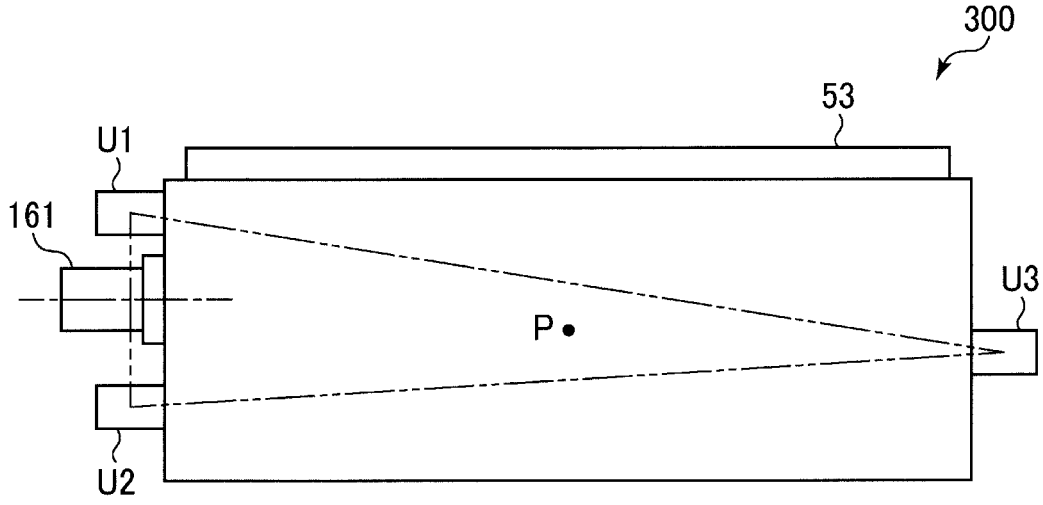
FIG. 23 is a view of the developing unit as seen in the H direction shown in FIG. 18.

A description will be given of a case in which the support posts in the vicinity of the supplying roller gear 313 are positioned at different positions in gravitational directions as shown in FIG. 18. FIG. 23 is a view of the developing unit 300 as seen in a direction shown by arrow H in FIG. 18. To cancel out the weight of the developing unit 300, the support posts U1, U2, and U3 are arranged such that the center of gravity of the developing unit 300 lies in a triangular horizontal plane in which the longitudinal axes of the support posts U1, U2, and U3 lie.

Figure 18A:
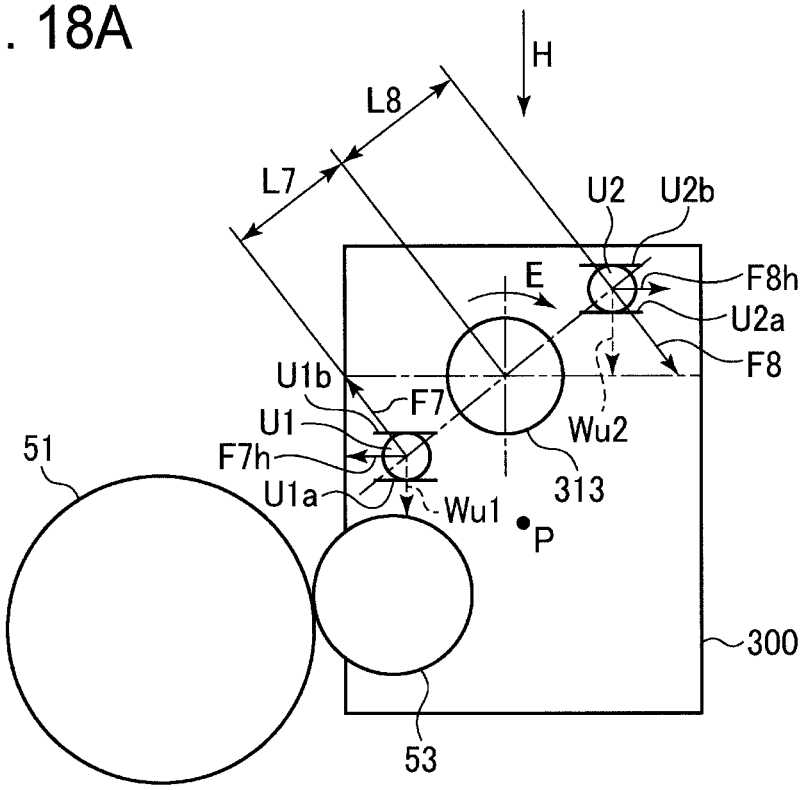
Figure 18B:
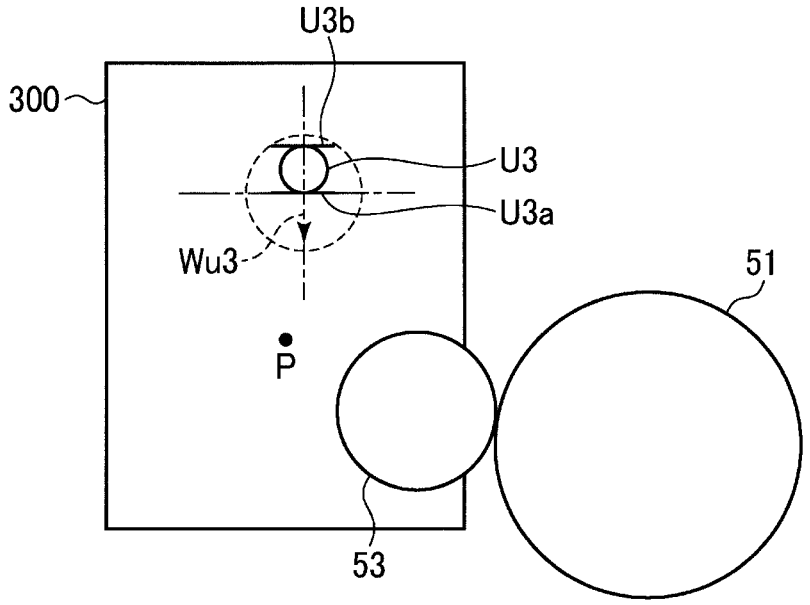

As shown in FIGS. 18A and 18B, to cancel out the weights Wu1, Wu2, and Wu3 exerted on the support posts U1, U2, and U3, counter forces should be applied at horizontal surfaces U1*a*, U2*a*, and U3*a* of the support posts U1, U2, and U3, the counter forces acting in directions opposite to the weights Wu1, Wu2, and Wu3.

To support the developing unit 300 such that the developing unit 300 can move in horizontal directions while the torque or turning effect is cancelled out, stoppers with surfaces U1*b*, U2*b*, and U3*b* are formed on the body 100, the surfaces U1*b*, U2*b*, and U3*b* lying in horizontal planes substantially parallel to the horizontal planes U1*a*, U2*a*, and U3*a* and opposing the surfaces Ua1, Ua2, and Ua3. Forces F7 and F8 due to the torque applied to the developing unit 300 act on the support posts U1 and U2. However, the surfaces U1*a*, U2*a*, and U3*a* are horizontal and therefore horizontal forces F7*h* and F8*h* are generated.

The two forces F7*h* and F8*h* are parallel and opposite in direction. If the distance L7 between the support post U1 and the rotational axis O of the supplying roller gear 313 is equal to the distance L8 between the support post U2 and the rotational axis O, then the force F7*h* is equal to the force F8*h*, thereby cancelling out the forces F7*h* and F8*h*. Thus, even if the support posts U1 and U2 in the vicinity of the supplying roller gear 313 are positioned at different heights in gravitational directions, the torque or turning effect and weight can be cancelled out. There is no limitation on the position of the support post U3 in a gravitational direction, the support post U3 being on a side of the developing unit 300 opposite the support posts U1 and U2.

Figure 19A:
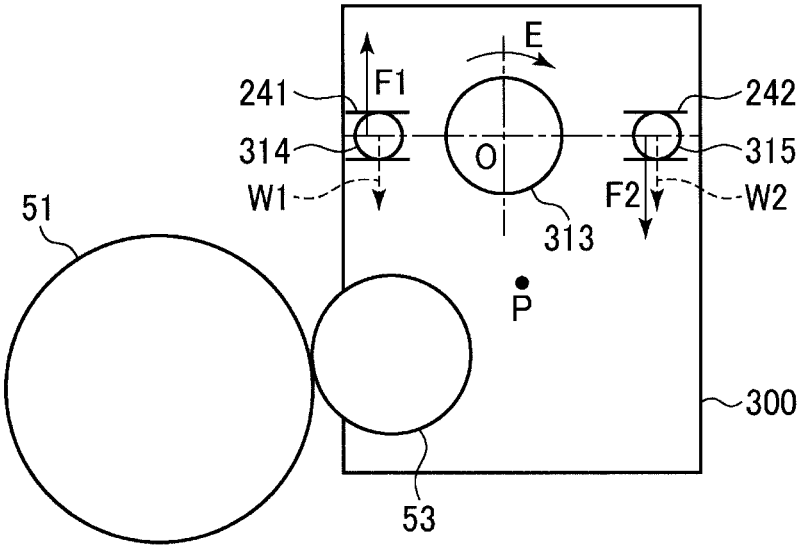
FIGS. 19A and 19B are another views illustrating the forces acting on the parts of the developing unit.
Figure 19B:
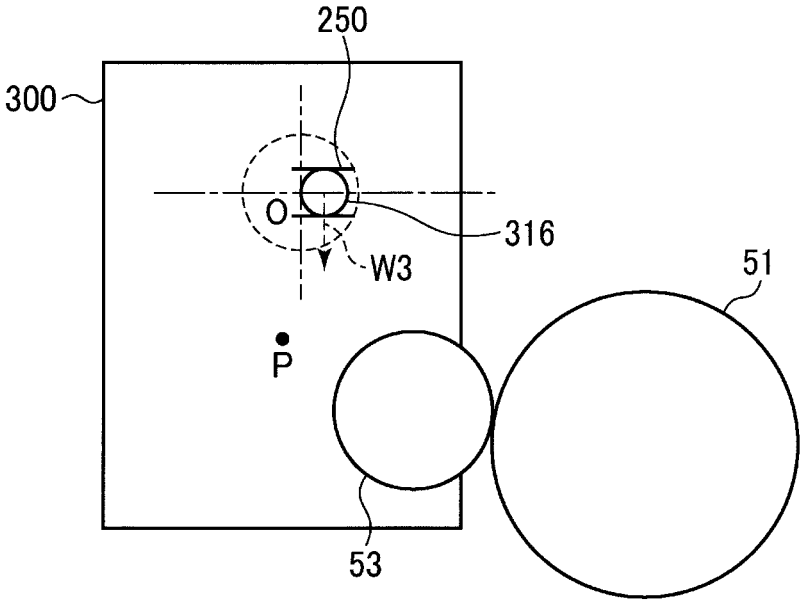
Figure 20:
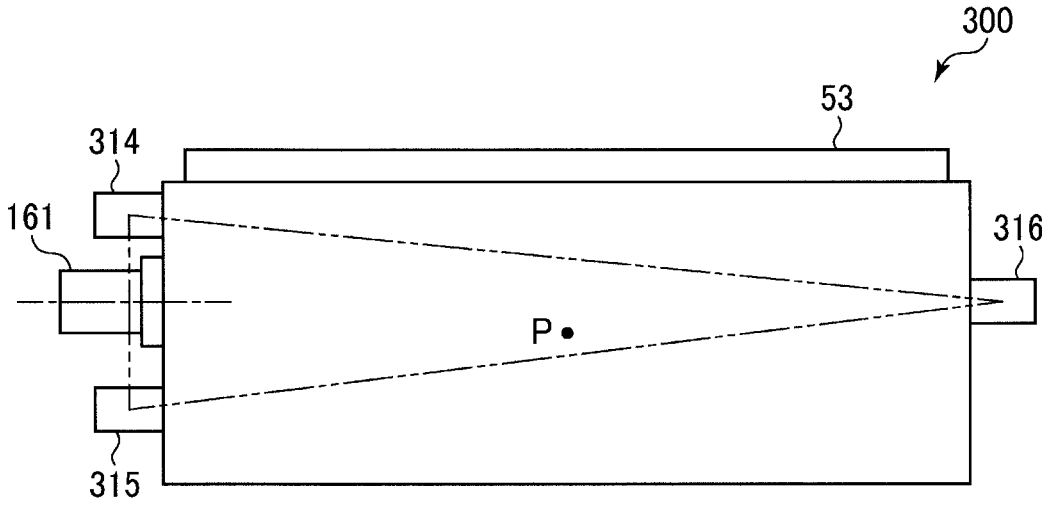
FIG. 20 is another view of the developing unit as seen from above or in a direction shown by arrow H in FIG. 16A.

FIGS. 19A and 19B are another views illustrating the forces acting on the parts of the developing unit 300. FIG. 20 is another view of the developing unit 300 as seen from above or in a direction shown by arrow H in FIG. 16A. With reference to FIGS. 19A-19B and 20, a description will be given of the operation of the developing unit 300 and the forces developed on the support posts 314, 315, and 316. In this embodiment, the torque or turning effect and weight are cancelled out by arranging the support posts as shown in FIGS. 17A and 17B and 22.

The support posts 314, 315, and 316 are in contact with the lower walls that define the positioning holes 241, 242, and 250, and exert the weights W1, W2, and W3, which are parts of the weight of the developing unit 300, on the lower surfaces.

Since the lower wall surfaces of the positioning holes 241, 242, and 250 are horizontal, the lower wall surfaces can receive the weights W1, W2 and W3 and the body of the developing unit 300 does not receive the reaction forces due to the weight of the developing unit 300.

When the supplying roller gear 313 receives a drive force via the developing roller coupling 161, and rotates in a direction shown by arrow E, the support posts 314 and 315 receive a force F1 due to rotational moment in a direction opposite to the gravitational direction and a force F2 due to rotational moment in the gravitational direction, so that the upper wall surface of the positioning hole 241 limits movement of the developing unit 300 in a direction opposite to the gravitational direction and the lower wall surface of the positioning hole 241 limits movement of the developing unit 300 in the gravitational direction.

The upper and lower wall surfaces of the positioning hole 241 are horizontal, and the support posts 314 and 315 receive the forces F1 and F2, respectively, resulting from the rotational moment due to the drive force, so that the support posts 314 and 315 are limited in movement by the upper and lower wall surfaces of the positioning hole 241 and 242, respectively. The above-described torque is cancelled out by the support posts 314 and 315 and therefore no force due to torque or turning effect acts on the support post 316.

An approach to cancel out the frictional force or eliminate the effects of the frictional force on the operation of the developing unit 300 will be described. The frictional force is developed at the contact area Ap in which the photoconductive drum 51 and the developing roller are in pressure contact with each other, and varies both in magnitude and direction due to fluctuations in rotational speed of the photoconductive drum 51 and the developing roller 53 and stick-slip that occurs on the surface of the developing roller 53.

Referring to FIG. 13, the photoconductive drum 51 is driven in rotation by a drive source (not shown) in the B direction, and the developing rollers 53 is driven in rotation by a drive source (not shown) in the D direction. The developing roller 53 is subject to frictional forces Fm1 and Fm2 which are in opposite directions with respect to rotation of the developing roller 53, and so the developing unit 300 tends to move in the direction of frictional force.

The urging force F220 of the urging member 220 has the component T220 preferably in a direction substantially perpendicular to or in the range of 70 to 110 degrees with the line passing through the urging member supporting post 320 and the contact area Ap. Likewise, the urging force F221 of the urging member 221 has the component T221 in the direction substantially perpendicular to the line passing through the urging member supporting post 321 and the contact area Ap.

The components T220 and T221 are substantially opposite in direction. The component T220 has a component against the frictional force Fm1 and the component T221 has a component against the frictional force Fm2. Specifically, the components T220 and T221 are opposite in direction with respect to a line perpendicular to a line tangent to the circumferential surface of the developing roller 53 at the contact area Ap. In FIG. 13, the component T220 acts in the upstream direction of the contact area Ap, and is against the frictional force Fm1, while the component T221 acts in the downstream direction of the contact area Ap, and is against the frictional force Fm2. Thus, the frictional forces Fm1 and Fm2 and the components T220 and T221 cancel out each other, respectively, thereby minimizing the effects of the frictional forces on the contact pressure at the contact area Ap.

As shown FIG. 14, due to stick-slip, the photoconductive drum 51 is subject to a frictional force Fm3 substantially in the direction of rotation of the photoconductive drum 51 and a frictional force Fm4 substantially in the direction opposite to the direction of rotation of the photoconductive drum 51.

The urging force F220 has a component Ts220 perpendicular to a line passing through the urging member supporting post 320 and the rotational axis As of the photoconductive drum 51. The urging force F221 has a component Ts221 perpendicular to a line passing through the urging member supporting post 321 and the rotational axis As of the photoconductive drum 51.

The components Ts220 and Ts221 are opposite in direction. The component Ts220 has a component against a frictional force Fm3 and the component Ts221 has a component against a frictional force Fm4. In FIG. 14, the component Ts220 is against the frictional force Fm3 and the component Ts221 is against the frictional force Fm4. Thus, the frictional forces Fm3 and Fm4 and the components Ts220 and Ts221 cancel out each other, respectively, thereby minimizing fluctuations of the position of the rotational axis As of the photoconductive drum 51.

The urging members 230 and 231, which are mounted on a side of the developing unit 300 opposite the supplying roller gear 313, operate in a similar manner to the urging members 220 and 221, and their detailed description is omitted.

As described above, the effects of the torque or turning effect, weight, and frictional force on the contact pressure at the contact area Ap are minimized, so that the photoconductive drum 51 and developing roller 53 are in pressure contact with each other substantially only by the urging force of the urging members.

The position of the urging members may be altered as required. For example, while the urging members 220 and 221 extend horizontally in FIG. 11, they may extend in directions at an angle with the horizontal direction and therefore may not be parallel with each other. FIG. 11 shows the urging members 220 and 221 disposed below the support posts 314 and 315. Instead, one of the urging members 220 and 221 may be disposed above the support posts 314 and 315 and the other of the urging members 220 and 221 may be disposed below the support posts 314 and 315. In FIGS. 11 and 12, two pairs of urging members are disposed in a manner such that one of the two pairs is a mirror image of the other. Although two urging members are disposed on each longitudinal end of the image forming unit 121, a plurality of urging members may be disposed on at least one longitudinal end. For example, two urging members may be disposed on one longitudinal end and only one urging member may be disposed on the other longitudinal end. Still alternatively, three urging members may be disposed on one longitudinal end.

{Effects}

The first embodiment provides the following advantages (1)-(8).

(1) A plurality of urging members are mounted on one longitudinal end of the image forming unit 121, and urge the photoconductive drum 51 and the developing roller 53 against each other. Therefore, each urging member may have a smaller urging force in this configuration in which two urging members are mounted on each longitudinal end than in a conventional configuration in which only one urging member is mounted on each longitudinal end. The use of a plurality of urging members permits the total urging force to be dispersed, allowing each urging member to have a smaller urging force. Therefore, using urging members with a smaller urging force provides a reliable, large urging force. In addition, the configuration reduces the loads exerted on members that support the urging members, thereby permitting the urging member support posts 320, 321, 330, 331 and end frames 304 and 305 to be less rigid. Since the urging force is dispersed, the urging members may be mounted without difficulty, improving the assembly efficiency.

For image forming apparatus capable of printing on a large size paper, i.e., A2 size or larger, the photoconductive drum 51 and the developing roller 53 are required to be under uniform pressure contact over a greater length and therefore a larger urging force is required, in which case the configuration of the first embodiment is effective.

The contact area Ap is in a space between the plane L220 in which the urging member supporting post 320 and the urging force F220 lie and the plane L221 in which the urging member supporting post 321 and the urging force F221 lie. This configuration permits the frictional forces developed at the contact area Ap and the urging forces F220 and F221 to cancel out each other, reducing the effect of the frictional forces on the operation of the developing unit 300 and providing a stable contact pressure between the photoconductive drum 51 and the developing unit 300. As a result, the configuration prevents or minimizes deterioration of print quality which would otherwise result from toner fog, white spots, poor graininess, and the filming of the developer material.

(3) The urging force F220 has the component T220 and the urging force F221 has the component T221. The components T220 and T221 act in opposite directions which are parallel to the line tangent to the developing roller 53 at the contact area Ap. In the first embodiment, the urging forces F220 and F221 cancel out the frictional forces developed at the contact area Ap. Thus, this configuration reduces the effect of the frictional forces developed between the photoconductive drum 51 and the developing roller 53, thereby providing a reliable contact pressure at the contact area Ap as well as preventing or minimizing deterioration of print quality.

(4) Due to the configuration of the first embodiment, the rotational axis As of the photoconductive drum 51 lies in a space between the plane L220 in which the urging member support post 320 and the urging force F220 lie and the plane L221 in which the urging member support post 321 and the urging force F221 lie. The configuration of the first embodiment is effective in minimizing fluctuation of the position of the rotational axis caused by the frictional force which would otherwise be developed at the contact area Ap, so that a stable contact pressure can be obtained at the contact area Ap.

(5) The components Ts220 and Ts221 act in opposite directions parallel to a line tangent to the photoconductive drum 51 at the contact area Ap. This configuration minimizes fluctuation of the rotational axis As of the photoconductive drum 51 which would otherwise be caused by the frictional force developed at the contact area Ap, thereby providing a stable contact pressure at the contact area Ap.

(6) The urging members 220 and 221 extend in directions substantially parallel to the direction in which the developing unit 300 moves into and out of contact engagement with the photoconductive drum 51. In the first embodiment, the developing unit 300 is efficiently urged in the direction in which the developing unit 300 moves into and out of contact engagement with the photoconductive drum 51.

(7) The developing unit 300 moves in a substantially horizontal direction so that the developing roller 53 moves into and out of contact engagement with the photoconductive drum 51, minimizing the effect of gravity on the contact pressure at the contact area Ap.

(8) The engagement means (i.e., support posts or stoppers) and engaged means (i.e., stoppers or support posts) according to the first embodiment are such that the turning effect due to rotational moment applied to the developing roller 53 and the weight of the developing unit 300 are cancelled out or the effect of the torque or turning effect and weight is minimized. Thus, the configuration of the first embodiment minimizes the effects of the torque or turning effect and weight on the contact pressure at the contact area Ap, and prevents or reduces the deterioration of print quality.

Second Embodiment

Figure 24:
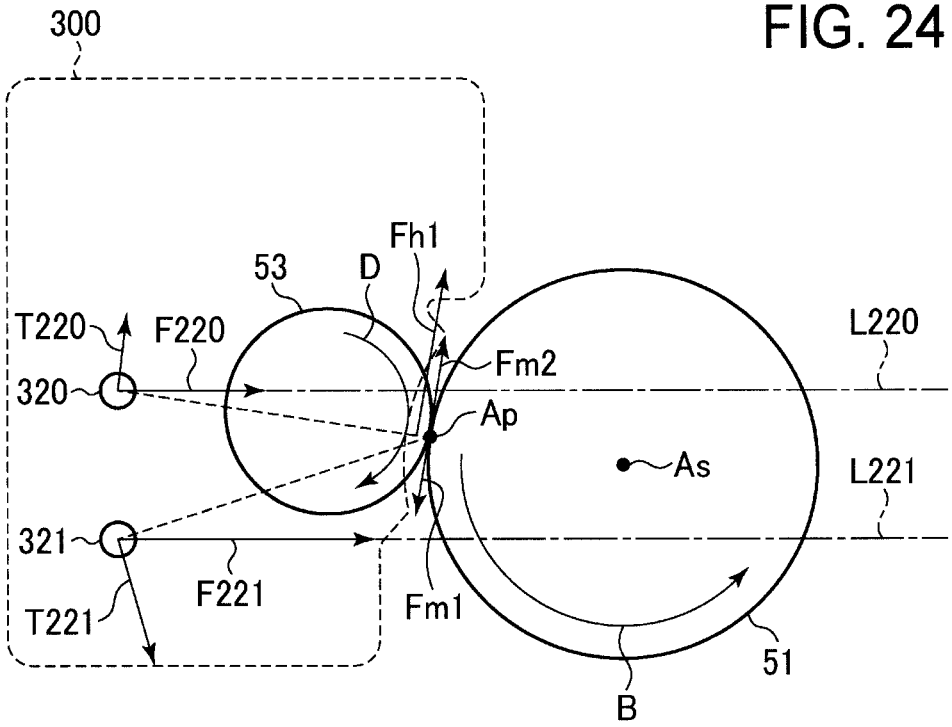
FIGS. 24 and 25 illustrate how a photoconductive drum and a developing roller of a second embodiment are urged against each other.
Figure 25:
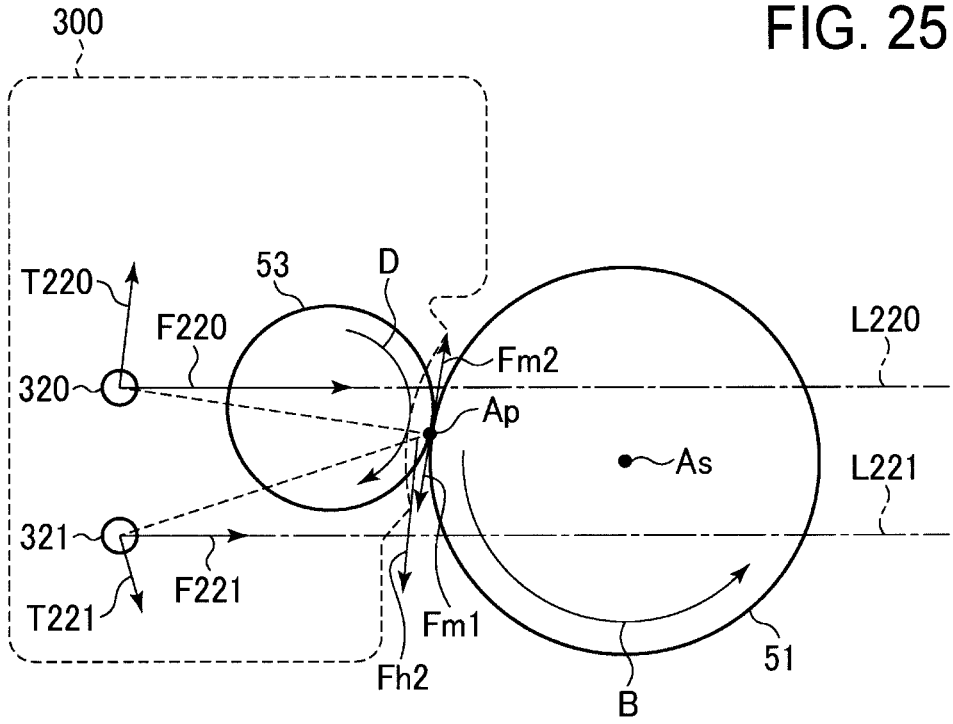

FIGS. 24 and 25 illustrate how a photoconductive drum 51 and a developing roller 53 according to a second embodiment are urged against each other. Elements similar to those of the first embodiment have been given similar reference characters and their detailed description is omitted.

Referring to FIGS. 24 and 25, the photoconductive drum 51 and developing roller 53 rotate in opposite rotational directions, so that their circumferential speeds at the contact area Ap are in the same direction.

Urging members 220 and 221 are disposed to satisfy the following conditions. An urging member supporting post 320 and an urging force F220 lie in a plane L220 that is located on the upstream side of the contact area Ap with respect to rotation of the developing roller 53. An urging member supporting post 321 and an urging force F221 lie in a plane L221 that is located on the downstream side of the contact area Ap.

The urging members 220 and 221 are also disposed to satisfy the following conditions. The urging force F220 has a component T220 acting in the upstream direction of the contact area Ap with respect to rotation of the developing roller 53, and the urging force F221 has a component T221 acting in the downstream direction of the contact area Ap.

In FIG. 24, the circumferential speed V53 of the developing roller 53 is higher than that V51 of the photoconductive drum 51, and the urging force F220<F221 (i.e., T220<T221).

In FIG. 25, the circumferential speed V53 of the developing roller 53 is lower than that V51 of the photoconductive drum 51, and the urging force F220>F221 (i.e., T220>T221).

The operation of an image forming unit 121 according to the second embodiment will be described. Referring to FIGS. 24 and 25, the photoconductive drum 51 is driven by a drive source (not shown) to rotate in a direction shown by arrow B. The developing roller 53 is driven by a drive source (not shown) to rotate in a direction shown by arrow D. At this time, stick-slip occurs at the contact area Ap, so that a frictional force Fm1 is developed in a direction tangent to the circumferential surface of the developing roller 53 and a frictional force Fm2 is developed in the direction opposite to the Fm1. The frictional forces Fm1 and Fm2 are cancelled out each other as described in the first embodiment.

In FIG. 24, the circumferential speed V53 of the developing roller 53 is higher than the circumferential speed V51 of the photoconductive drum 51. Thus, the developing roller 53 is also subjected to a frictional force Fh1 acting in such a direction as to decrease the circumferential speed of the developing roller 53. At this time, F220<F221. Therefore, T221 is larger than T220 when F220<F221 than when F220≥F221, so that the relatively large T221 cancels the frictional force Fh1.

In FIG. 25, V53<V51. Therefore, the developing roller 53 is subjected to a frictional force Fh2 acting in such a direction as to increase the circumferential speed of the developing roller 53. At this time, F220>F221. Therefore, T221 is larger when F220>F221 than when F220≤F221, so that the T220>T221, and the relatively larger T220 cancels out the frictional force Fh2.

As described above, in the second embodiment, when the circumferential speed V53 of the developing roller 53 is higher than that V51 of the photoconductive drum 51, the urging forces are set such that F221>F220, and when the circumferential speed of the developing roller 53 is lower than that of the photoconductive drum 51, the urging forces are set such that F220>F221. Thus, when the circumferential speed V53 of the developing roller 53 differs from that V51 of the photoconductive drum 51 and there exists the frictional force that tends to decrease the circumferential speed of the developing roller 53 or there exists the frictional force that tends to increase the circumferential speed of the developing roller 53, the frictional forces Fh1 and Fh2 are advantageously or efficiently cancelled out, thereby reducing the effect of the frictional force on the operation of the image forming unit 121.

The present invention is not limited to the first and second embodiments, and may be modified in a variety of ways without departing from the scope of the invention. For example, the present invention may be applicable to a variety of devices including copying machines, LED printers, laser beam printers, facsimile machines, and MFPs. While the first and second embodiments have been described in terms of the support posts slidable on the wall surfaces of elongate positioning holes or slotted positioning openings, the support posts may rotate on the wall surfaces. For example, the support posts may take the form of rollers configured to rotate about shafts secured to the developing unit 300.

What is claimed is:

1. An image forming unit, comprising:

a first unit including image bearing body on which an electrostatic latent image is formed, and which is rotatably supported;

a second unit including a second engagement portion and a developer material bearing body that develops the electrostatic latent image with a developer material into a developer image, and which is rotatably supported, the second unit being coupled to the first unit such that the first engagement portion engages the second engagement portion; and a plurality of urging members that are mounted in a vicinity of one end of an axis of rotation of the developer material bearing body and urge the first unit and the second unit in directions such that the image bearing body and the developer material bearing body are urged against each other.

2. The image forming unit according to claim 1, wherein the plurality of urging members includes a first urging member and a second urging member, wherein the second unit comprises a first supporting portion that supports the first urging member and a second supporting portion that supports the second urging member;

wherein the developer material bearing body includes a contact surface area such that the developer material bearing body is movable into and out of contact engagement with the image bearing body at the contact surface area;

wherein the first urging member applies a first urging force to the first supporting portion, and the second urging member applies a second urging force to the second supporting portion so that the developer material bearing body is urged against the image bearing body.

3. The image forming unit according to claim 2, wherein the contact surface area lies between a first plane in which the first supporting portion and the first urging force lie and a second plane in which the second supporting portion and the second urging force lie.

4. The image forming unit according to claim 3, wherein the image bearing body rotates at a first circumferential speed and the developer material bearing body rotates at a second circumferential speed, so that the first and second circumferential speeds are in a common direction in the contact surface area;

wherein the first plane lies on an upstream side of the contact surface area with respect to rotation of the developer material bearing body and the second plane lies on a downstream side of the contact surface area.

5. The image forming unit according to claim 4, wherein the first urging force and the second urging force differ in magnitude.

6. The image forming unit according to claim 4, wherein the second circumferential speed is higher than the first circumferential speed, and the second urging force is greater than the first urging force.

7. The image forming unit according to claim 4, wherein the second circumferential speed is lower than the first circumferential speed, and the first urging force is greater than the second urging force.

8. The image forming unit according to claim 2, wherein the image bearing body includes an axis of rotation that lies in a space between a first plane in which the first supporting portion and the first urging force lie and a second plane in which the second supporting portion and the second urging force lie.

9. The image forming unit according to claim 4, wherein the first urging force has a first component toward the contact surface area and a second component acting in a direction substantially perpendicular to the first component, and the second urging force has a third component toward the contact surface area and a fourth component acting in a direction substantially perpendicular to the third component, the second component and the fourth component are acting in directions substantially opposite to each other and substantially parallel to a line tangent to the developer material bearing body at the contact surface area.

10. The image forming unit according to claim 9, wherein the first circumferential speed is higher than the second circumferential speed;

wherein the first component is toward an upstream side of the contact surface area and the second component is toward a downstream side of the contact surface area; and wherein the second urging force is larger than the first urging force.

11. The image forming unit according to claim 9, wherein the developer material bearing body rotates at a first circumferential speed and the image bearing body rotates at a second circumferential speed, the first and second circumferential speeds are in a common direction at the contact surface area, the first circumferential speed being lower than the second circumferential speeds;

wherein the first component is toward an upstream side of the contact surface area and the second component is toward a downstream side of the contact surface area; and wherein the first urging force is larger than the second urging force.

12. The image forming unit according to claim 2, wherein the first urging force has a fifth component toward an axis of rotation of the image bearing body and a sixth component acting in a direction perpendicular to the fifth component, the second urging force has a seventh component toward the axis of rotation of the image bearing body and an eighth component acting in a direction perpendicular to the seventh component, the sixth component and the eighth component are acting in directions substantially opposite to each other and parallel to a line tangent to the developer material bearing body.

13. The image forming unit according to claim 2, wherein the first engagement portion and the second engagement portion permit the image bearing body and the developer material bearing body to move in directions in which the image bearing body and the developer material bearing body move into and out of contact engagement with each other, but prevents the image bearing body and the developer material bearing body from moving and rotating in directions except for the directions in which the image bearing body and the developer material bearing body move into and out of contact engagement with each other.

14. The image forming unit according to claim 13, wherein the first urging member and the second urging member are disposed such that the first urging force and the second urging force are acting in directions substantially parallel to the direction in which the image bearing body and the developer material bearing body move into and out of contact engagement.

15. The image forming unit according to claim 1, wherein the first engagement portion includes:

a first positioning hole formed in the first unit in a vicinity of one end of an axis of rotation of the developer material bearing body, a second positioning hole formed in the vicinity and spaced apart from the first positioning hole, and a third positioning hole formed in the first unit in a vicinity of the other end of the axis of rotation of the developer material bearing body;

wherein the second engagement portion includes:

a first post that engages the first positioning hole, a second post that engages the second positioning hole, and a third post that engages the third positioning hole.

16. The image forming unit according to claim 15, wherein the second unit has a center of gravity in a triangular plane defined by the first post, second post, and the third post.

17. The image forming unit according to claim 16, wherein the second unit includes a drive force receiving portion through which a drive force is received for rotating the developer material bearing body, the drive force receiving portion being rotatably supported on the second unit;

wherein the third positioning hole and the third post are disposed in a vicinity of the axis of rotation of the drive force receiving portion.

18. The image forming unit according to claim 16, wherein the axis of rotation of the drive force receiving portion is substantially in the midway between the first post and the second post.

19. The image forming unit according to claim 16, wherein the drive force receiving portion is in a vicinity of one end of the axis of rotation of developer material bearing body.

20. The image forming unit according to claim 1, wherein the image forming unit is incorporated in an image forming apparatus.

* * * * *